US012703406B2

(12) United States Patent
Zhou et al.

(10) Patent No.: US 12,703,406 B2
(45) Date of Patent: Aug. 11, 2026

(54) METHOD FOR IMPROVING CURVILINEAR RUNNING SPEED OF RAILWAY VEHICLE AND SMART TILTING SYSTEM

(71) Applicant: Zhuzhou Times New Material Technology Co., Ltd., Hunan (CN)

(72) Inventors: Jun Zhou, Hunan (CN); Canhui Chen, Hunan (CN); Yan Luo, Hunan (CN); Wei Li, Hunan (CN); Xiang Yin, Hunan (CN); Lida Wang, Hunan (CN); Xiaohu Wang, Hunan (CN); Haitao Cheng, Hunan (CN); Wensong Liu, Hunan (CN); Sheng Lin, Hunan (CN)

(73) Assignee: Zhuzhou Times New Material Technology Co., Ltd., Hunan (CN)

( * ) Notice: Subject to any disclaimer, the term of this patent is extended or adjusted under 35 U.S.C. 154(b) by 413 days.

(21) Appl. No.: 18/565,520

(22) PCT Filed: Apr. 29, 2022

(86) PCT No.: PCT/CN2022/090556
§ 371 (c)(1),
(2) Date: Nov. 30, 2023

(87) PCT Pub. No.: WO2023/206468
PCT Pub. Date: Nov. 2, 2023

(65) Prior Publication Data
US 2024/0270291 A1 Aug. 15, 2024

(51) Int. Cl.
*B61F 5/38* (2006.01)

(52) U.S. Cl.
CPC ..... *B61F 5/386* (2013.01)

(58) Field of Classification Search
CPC ..... B61F 5/38; B61F 5/383; B61F 5/386
See application file for complete search history.

(56) References Cited

FOREIGN PATENT DOCUMENTS

| | | |
|---|---|---|
| CN | 1345673 | 4/2002 |
| CN | 112046532 | 12/2020 |
| CN | 112896214 | 6/2021 |

(Continued)

OTHER PUBLICATIONS

"International Search Report (Form PCT/ISA/210) of PCT/CN2022/090556," mailed on Jan. 20, 2023, with English translation thereof, pp. 1-4.

*Primary Examiner* — Robert J McCarry, Jr.
(74) *Attorney, Agent, or Firm* — JCIPRNET

(57) ABSTRACT

A method for improving the curvilinear running speed of railway vehicles and the small tilting system: when the railway vehicle is driven on a curve, the raising and falling of air springs on both sides of the railway vehicle are controlled by a control assembly to realize small tilting of the railway vehicle toward the inner side of the curve; the transverse component of gravity after the small tilting of the railway vehicle is used for balancing part of the centrifugal force and reducing the influence of the centrifugal force, thereby improving the curve driving speed of the railway vehicle; and at the same time, an adjustable torsion bar system is controlled to provide a unidirectional anti-rolling torque for preventing the railway vehicle from rolling toward the outer side of the curve without hindering the railway vehicle from tilting slightly toward the inner side of the curve.

6 Claims, 27 Drawing Sheets

(56) References Cited

FOREIGN PATENT DOCUMENTS

| | | | | | |
|---|---|---|---|---|---|
| CN | 112896215 | | | 6/2021 | |
| CN | 112896216 | | | 6/2021 | |
| ES | 2101377 | | | 7/1997 | |
| JP | H0656034 | | | 3/1994 | |
| JP | 2002316641 | | | 10/2002 | |
| JP | 2007176400 | A | * | 7/2007 | ..... G06T 7/00 |
| JP | 2008254577 | | | 10/2008 | |
| JP | 2008254577 | A | * | 10/2008 | |

* cited by examiner

METHOD FOR IMPROVING CURVILINEAR RUNNING SPEED OF RAILWAY VEHICLE AND SMART TILTING SYSTEM

CROSS-REFERENCE TO RELATED APPLICATION

This application is a 371 of international application of PCT application serial no. PCT/CN2022/090556, filed on Apr. 29, 2022. The entirety of the above-mentioned patent application is hereby incorporated by reference herein and made a part of this specification.

TECHNICAL FIELD

The present invention relates to the technical field of railway vehicles, and particularly relates to a method for improving the curvilinear running speed of railway vehicles and a small tilting system.

DESCRIPTION OF RELATED ART

With the continuous improvement of requirements for vehicle operating speed and riding comfort, the existing vehicle suspension system is difficult to satisfy the safety and comfort requirements when a train passes through a curve at high speed. A tilting train can enable a vehicle body to actively tilt before the train reaches the curve, and to balance the centrifugal force on the curve by its own gravity, so compared with the traditional railway transit vehicles, the tilting train can better solve the problems of safety and comfort when passing through the curve at high speed.

The tilting trains can be classified into natural tilting and forced tilting according to different tilting ways of the vehicle body. Natural tilting is also known as passive tilting. The vehicle body is supported by a roller device and a high air spring. When the train passes through the curve, the centrifugal force is generated, so that the vehicle body rotates around the center of tilting. In the absence of external power, the vehicle body naturally tilts to the inner side of the curve. The slope angle of the passive tilting vehicle body can reach 3°-5°, which can increase the curve operating speed of the conventional train by 10%-20%. However, the passive tilting has the problems of complex structure, high cost and unsuitability for the transformation of the existing railway vehicles.

Forced tilting is also known as active tilting, that is, tilting by using a curve monitoring device, a vehicle-mounted computer control device and a tilting transmission device. Forced tilting can be classified into large tilting and small tilting: the tilting angle of large tilting can reach 10°, which increases the conventional train curve operating speed by 30%-35%, and large tilting has complex structure, high cost and unsuitability for the transformation of the existing railway vehicles.

The function of an anti-rolling torsion bar is to prevent the rolling of the railway vehicles caused by passage through the curve, strong wind and bump to ensure driving safety. When the vehicle body is in the active tilting, the anti-rolling torsion bar will hinder the vehicle body from tilting. Thus, it is necessary to improve a connecting rod of an anti-rolling torsion bar system to adapt to the active tilting of the vehicle body: when the railway vehicle is driven on a straight route or a large curvature radius route, the anti-rolling torsion bar is required to provide bidirectional anti-rolling torque to prevent the vehicle body from rolling left and right. When the railway vehicle is driven on a small curvature radius route, the anti-rolling torsion bar is required to match with an air spring system to enable the vehicle body to tilt toward the inner side of the curve and to provide unidirectional anti-rolling torque to prevent the vehicle body from rolling toward the outer side of the curve.

Therefore, a technical problem to be solved by the present invention is to realize the functions of small tilting and unidirectional anti-rolling of the railway vehicle by using the existing air spring system and the improved anti-rolling torsion bar of the railway vehicle to increase the driving speed of the railway vehicle on the curve.

Through patent retrieval, the following patents are mainly related to the present application:

1. Patent for invention with application No. "CN01116606.1", application date "2001.04.13", publication No. "CN1345673A", publication date "2002.04.24", title "railway vehicle" and applicant "HITACHI, LTD.". In the patent for invention, a vehicle body 8 is supported on a bogie seat 4 through an air spring 5. A torsion bar 11 is configured on the bogie seat 4 along the transverse direction of the vehicle body 8. Connecting rods 15 tilted towards the inner side of the vehicle body 8 are configured at both ends of the torsion bar 11 by levers 13. Thus, the swing at both ends of the vehicle body can be restricted, but the upper and lower movements are not restricted simultaneously. In the event of excessive centrifugal acceleration acting on the vehicle body 8, the vehicle body tilts with a connecting rod mechanism. The patent uses the centrifugal force generated by the vehicle when driving in the curve to make the vehicle offset to the outer side of the curve, so that the angles of the connecting rods on both sides of the vehicle are changed, thereby changing the reaction force of the torsion bar on both sides of the vehicle. Thus, the vehicle tilts to the inner side of the curve, and the gravity component after the vehicle tilts is used to balance the centrifugal force. It is a passive balance method.

2. Patent for invention with application No. "94104993.4", application date "1994.03.30", publication No. "ES2101377T3", publication date "1997.07.01", title "anti-balancing device for railway vehicle" and applicant "WAGGONFABRIK TALBOT GMBH & CO". The patent for invention describes a method for combining traditional mechanical vibration support on a railway vehicle with active transverse slope control. According to the present invention, at least one adjustable connector (10) is provided; the connector (10) is longitudinally adjustable by a controllable driving element (11); and the driving element has a supporting piece (8). The supporting piece is placed wiggly in a carriage housing of the vehicle or transversally placed on a movable frame, and supported on a movable mechanism (1,1) that bears unnecessary transverse slope on a side surface of a box body (4) of a truck. The longitudinal variation of the connecting piece (10) is controlled to make the connecting piece start from a neutral slope angle position, so that a carriage (4) actively tilts onto a movable frame (1) that can be used to improve the centrifugal force offset on the curve. Preferably, the combination according to the present invention is suitable for the addition of equipment to the passenger carriages of the traditional railway in the sense of increasing comfort and/or reducing travel time. The patent is complex in structure, high in cost and not applicable to the transformation of the existing railway vehicles.

3. Patent for invention with application No. "JP21044292", application date "1992.08.06", publication No. "JPH0656034A", publication date "1994.03.01", title "tilting device for locomotive vehicle body" and applicant "NIPPON SHARYO SEIZO KK". The patent for invention discloses a body tilting device for a locomotive vehicle, wherein the operating speed is increased by large displacement from ultrahigh balance speed and further by maintaining safe eccentricity. Composition: for example, when driving in a curve, a left rod 47L is lowered and a right rod 47R is raised to drive a hydraulic actuator 35R, so that the vehicle body 1 is tilted to the left. Here, an ultrahigh center C is put below the vehicle body 1, the center of gravity is moved to the ultrahigh inner side, and the weight of inner wheels is increased to offset the weight of outer wheels increased by the centrifugal force. Therefore, the safe eccentricity is maintained to increase the operating speed. Here, by moving a push-pull cable, when the preset length of left/right height adjusting rods is shorter than a reference value on the left by a predetermined amount, and when right/left air springs 5L are longer than the reference value by a predetermined amount, the 5R is kept balanced with the left low and the right high. Therefore, since the generated action causes the vehicle body 1 to tend to remain in an ultrahigh state, the overheight of the vehicle body 1 may not be disturbed when driving in the curve. The patent is complex in structure, high in cost and not applicable to the transformation of the existing railway vehicles.

However, the above patent is different from the technical solution in the present application and its tilting system is complex in structure, high in cost and not applicable to the transformation of the existing railway vehicles. Moreover, the length of the connecting rods cannot realize real-time unidirectional follow-up adjustment, and cannot provide unidirectional anti-rolling torque.

SUMMARY

A technical problem to be solved in the present invention is to overcome the defects in the prior art, to provide a method for improving the curvilinear running speed of railway vehicles and the small tilting system.

To solve the above technical problems, the present invention adopts the following technical solution: a method for improving the curvilinear running speed of railway vehicles: when the railway vehicle is driven on a curve, the raising and falling of air springs on both sides of the railway vehicle are controlled by a control assembly to realize small tilting of the railway vehicle toward the inner side of the curve; the transverse component of gravity after the small tilting of the railway vehicle is used for balancing part of the centrifugal force and reducing the influence of the centrifugal force, thereby improving the curve driving speed of the railway vehicle; and at the same time, an adjustable torsion bar system is controlled to provide a unidirectional anti-rolling torque for preventing the railway vehicle from rolling toward the outer side of the curve without hindering the railway vehicle from tilting slightly toward the inner side of the curve, so as to ensure the driving safety of the railway vehicle on the curve. The existing air spring system and the anti-rolling torsion bar of the railway vehicle are upgraded and reformed so that the railway vehicle has the functions of small tilting and unidirectional anti-rolling. On the basis of the existing railway vehicle structure, a slight reformation of the railway vehicle is only needed to make the railway vehicle body generate the maximum tilting angle of 3°, so that the speed increase can reach 10-20%, which has the advantages of simple structure and low cost, has good economy and practicality, and is suitable for the transformation and large-scale promotion of the existing railway vehicles. By increasing the curve driving speed of the railway vehicle, the energy consumption caused by deceleration and acceleration when the railway vehicle passes through the curve can be reduced; and at the same time, the driving time of the railway vehicle can be saved, the operation efficiency can be increased, and good economic benefits are realized.

Further, the small tilting is realized by using a unilateral ascending tilting method or a one-ascending and one-descending tilting method.

Further, the unilateral ascending tilting method means that: the air spring on the outer side of the curve is inflated using the existing air spring system of the railway vehicle to make the railway vehicle body raised near the outer side of the curve, so that the railway vehicle has small tilting to the inner side of the curve. It has the advantage of simple control.

Further, the one-ascending and one-descending tilting method means that: the air spring on the outer side of the curve is inflated using the existing air spring system of the railway vehicle to make the railway vehicle body raised near the outer side of the curve; and meanwhile, the air spring on the inner side of the curve is deflated to make the railway vehicle body descended near the inner side of the curve, so that the railway vehicle has small tilting to the inner side of the curve. It has the advantages of large formed height difference, large tilting angle and large balance centrifugal force.

Further, the unidirectional anti-rolling torque means that: when the railway vehicle enters a transition curve, the adjustable torsion bar system is controlled to be in a unidirectional anti-rolling state, and the adjustable torsion bar system may not prevent the railway vehicle from tilting to the inner side of the curve. Once the railway vehicle has a tendency to roll to the outer side of the curve, the adjustable torsion bar system provides the unidirectional anti-rolling torque to prevent the railway vehicle from rolling to the outer side of the curve to ensure the driving safety of the railway vehicle on the curve.

Further, the adjustable torsion bar system comprises: a torsion bar and hydraulic connecting rods; the torsion bar is fixed on a bogie/vehicle body; both ends of the torsion bar are hinged with one end of the two hydraulic connecting rods respectively; the other ends of the two hydraulic connecting rods are hinged with both sides of the vehicle body/bogie respectively; the length of the connecting rods can be transformed between the states of fixing and unidirectional follow-up elongation only or unidirectional follow-up shortening only so that the torsion bar system provides a bidirectional anti-rolling torque or unidirectional anti-rolling torque to satisfy the safety driving requirements of the railway vehicle on different rails.

Further, the unidirectional anti-rolling torque means that: when the railway vehicle enters the transition curve, the length of the hydraulic connecting rod on the inner side of the curve is controlled to be locked and unchanged or in a unidirectional follow-up shortening state; the hydraulic connecting rod on the outer side of the curve is controlled to be in a unidirectional follow-up elongation state; when the railway vehicle inclines to the inner side of the curve, the length of the hydraulic connecting rod on the inner side of the curve is locked and unchanged or shortened with the tilting of the railway vehicle; the hydraulic connecting rod on the outer side of the curve extends with the swing of the railway vehicle; and once the railway vehicle has a tendency to roll to the outer side of the curve, the adjustable torsion bar system provides a unidirectional anti-rolling torque to prevent the railway vehicle from rolling to the outer side of the curve.

Further, each hydraulic connecting rod comprises: a rod body, a piston and a control component; the piston is movably arranged in the rod body: the rod body is divided into a liquid cavity I and a liquid cavity II; the liquid cavity I and the liquid cavity II are filled with liquid media; the liquid cavity I is connected with the liquid cavity II through a flow channel I and a flow channel II; a straight-through valve I and a check valve I are arranged on the flow channel I; the liquid media in the liquid cavity I can only flow to the liquid cavity II through the check valve I and the straight-through valve I; a straight-through valve II and a check valve II are arranged on the flow channel II; and the liquid media in the liquid cavity II can only flow to the liquid cavity I through the check valve II and the straight-through valve II. By controlling the unidirectional flow of the liquid media, the length of the connecting rods can realize unidirectional follow-up elongation or unidirectional follow-up shortening.

Further, when the straight-through valve I is connected and the straight-through valve II is disconnected, the liquid media in the liquid cavity I can only flow to the liquid cavity II through the flow channel I, and the length of the connecting rod is freely elongated under the action of tension; and when the tension is converted into pressure, the liquid media in the liquid cavity II cannot flow to the liquid cavity I, the length of the connecting rod remains unchanged, and the hydraulic connecting rod is in a state of unidirectional follow-up elongation. When the straight-through valve I is disconnected and the straight-through valve II is connected, the liquid media in the liquid cavity II can only flow to the liquid cavity I through the flow channel II, and the length of the connecting rod is freely shortened under the action of pressure; and when the pressure is converted into tension, the liquid media in the liquid cavity I cannot flow to the liquid cavity II, the length of the connecting rod remains unchanged, and the hydraulic connecting rod is in a state of unidirectional follow-up shortening.

The present application further relates to a small tilting system for realizing the above method for increasing the curve driving speed of the railway vehicle, comprising: an air cylinder, a left air spring and a right air spring; a control assembly is also arranged; compressed air is controlled to enter the left air spring/right air spring through the control assembly, or to be exhausted from the left air spring/right air spring, so that a height difference is generated between the left air spring and the right air spring to enable the railway vehicle to form a tilting angle $\beta$ to the inner side of the curve relative to a rail surface. The tilting angle of the formed railway vehicle body relative to the horizontal plane is increased from $\alpha$ to $\alpha+\beta$. The increased tilting angle $\beta$ is used for balancing a larger centrifugal force F. Therefore, the driving speed of the railway vehicle on the curve can be further increased and the safety and the comfort when passing through the curve can be improved.

Further, the control assembly comprises a left height adjusting valve, a left air valve I, a left air valve II, a right height adjusting valve, a right air valve I, a right air valve II and a middle height adjusting valve; the left air spring is connected with the air cylinder through the left air valve I and the left height adjusting valve, and is connected with the air cylinder through the left air valve II and the middle height adjusting valve; and the right air spring is connected with the air cylinder through the right air valve I and the right height adjusting valve, and is connected with the air cylinder through the right air valve II and the middle height adjusting valve. The height of the left air spring is controlled by the left height adjusting valve, and the height of the right air spring is controlled by the right height adjusting valve. The height difference and the tilting angle $\beta$ of the air springs on both sides can be controlled without signal monitoring and feedback system. The existing air spring system of the railway vehicle can be used for achieving the small tilting of the railway vehicle, with simple structure, low cost and suitability for the transformation of existing railway vehicle to increase the curve driving speed of the railway vehicle and improve operational efficiency.

Further, the control assembly comprises a left air valve II, a left air valve III, a left height limiting valve, a right air valve II, a right air valve III, a right height limiting valve and a middle height adjusting valve; the left air spring is connected with the air cylinder through the left air valve II and the middle height adjusting valve, connected with the air cylinder through the left air valve III, and deflated through the left height limiting valve; the right air spring is connected with the air cylinder through the right air valve II and the middle height adjusting valve, connected with the air cylinder through the right air valve III, and deflated through the right height limiting valve. The height of the left air spring is controlled by the left height limiting valve, and the height of the right air spring is controlled by the right height limiting valve. The height difference and the tilting angle $\beta$ of the air springs on both sides can be controlled without signal monitoring and feedback system. The existing air spring system of the railway vehicle can be used for achieving the small tilting of the railway vehicle, with simple structure, low cost and suitability for the transformation of existing railway vehicle to increase the curve driving speed of the railway vehicle and improve operational efficiency.

The present invention has the following beneficial effects: when the railway vehicle is driven on the curve, the compressed air that enters the air springs on both sides of the railway vehicle are controlled to generate a height difference on the air springs on both sides so that the railway vehicle realizes small tilting toward the inner side of the curve to increase the curve driving speed of the railway vehicle. The adjustable torsion bar system is controlled to provide the bidirectional anti-rolling torque or unidirectional anti-rolling torque to satisfy the safety driving requirements of the railway vehicle on different rails. On the basis of the existing railway vehicle structure, a slight reformation of the railway vehicle is only needed in the present application to make the railway vehicle body generate the maximum tilting angle of 3°, so that the speed increase can reach 10-20%, which has the advantages of simple structure and low cost, has good economy and practicality, and is suitable for the transformation and large-scale promotion of the existing railway vehicles.

DESCRIPTION OF THE EMBODIMENTS

The present invention is further described below through specific embodiments in combination with drawings.

Figure 1:
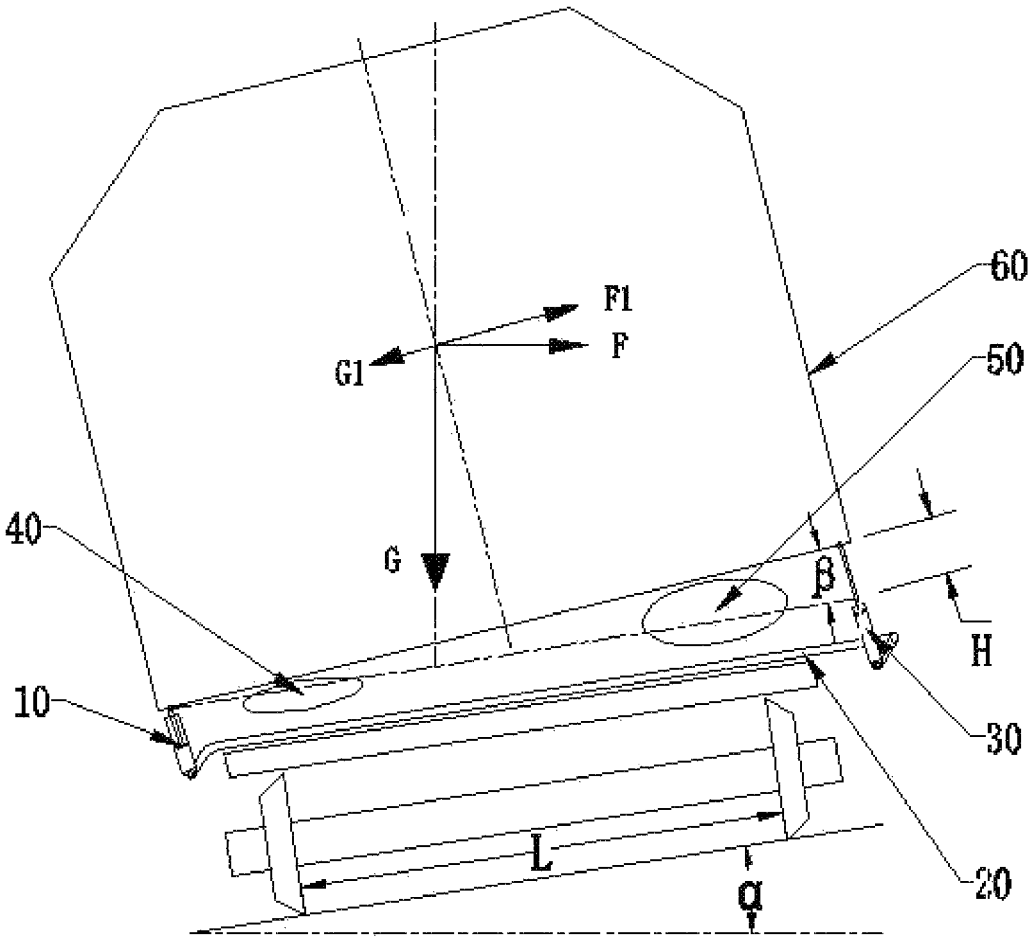
FIG. 1 is a schematic diagram of a railway vehicle that tilts on a curve.

As shown in FIG. 1: on a turning curve, rails are set ultrahigh (an outer rail plane is higher than an inner rail plane) to form an ultrahigh inclination angle $\alpha$, and a gravity component force G1 formed by gravity G after tilting is used for balancing or partially balancing a centrifugal force F.

To further improve the curve driving speed of the railway vehicle, the height of the railway vehicle body on the outer side of the curve is increased and the height on the inner side of the curve is reduced through technical measures, so that the two sides of the vehicle body generate a height difference H relative to the rail surface to form a tilting angle $\beta$ of the railway vehicle relative to the rail surface, and the formed inclination angle of the railway vehicle relative to the horizontal plane is increased from $\alpha$ to $\alpha$+B. The increased tilting angle $\beta$ is used for balancing a larger centrifugal force F. Therefore, the curve driving speed of the railway vehicle can be further increased, the centrifugal acceleration can be reduced, and the safety and the comfort when passing through the curve can be improved.

Embodiment 1 of the present invention, as shown in FIG. 2 to FIG. 6, comprises a small tilting adjusting system and an adjustable torsion bar system, and can adopt a unilateral ascending tilting method or a one-ascending and one-descending tilting method.

The small tilting adjusting system comprises: an air cylinder 90, a left air spring 40, a right air spring 50, a middle height adjusting valve 91, a left height adjusting valve 41, a left air valve I 42, a left air valve II 43, a right height adjusting valve 51, a right air valve I 52 and a right air valve II 53. The left air spring 40 is connected with the air cylinder 90 through the left air valve I 42 and the left height adjusting valve 41, and is connected with the air cylinder 90 through the left air valve II 43 and the middle height adjusting valve 91; and the right air spring 50 is connected with the air cylinder 90 through the right air valve I 52 and the right height adjusting valve 51, and is connected with the air cylinder 90 through the right air valve II 53 and the middle height adjusting valve 91.

Figure 12:
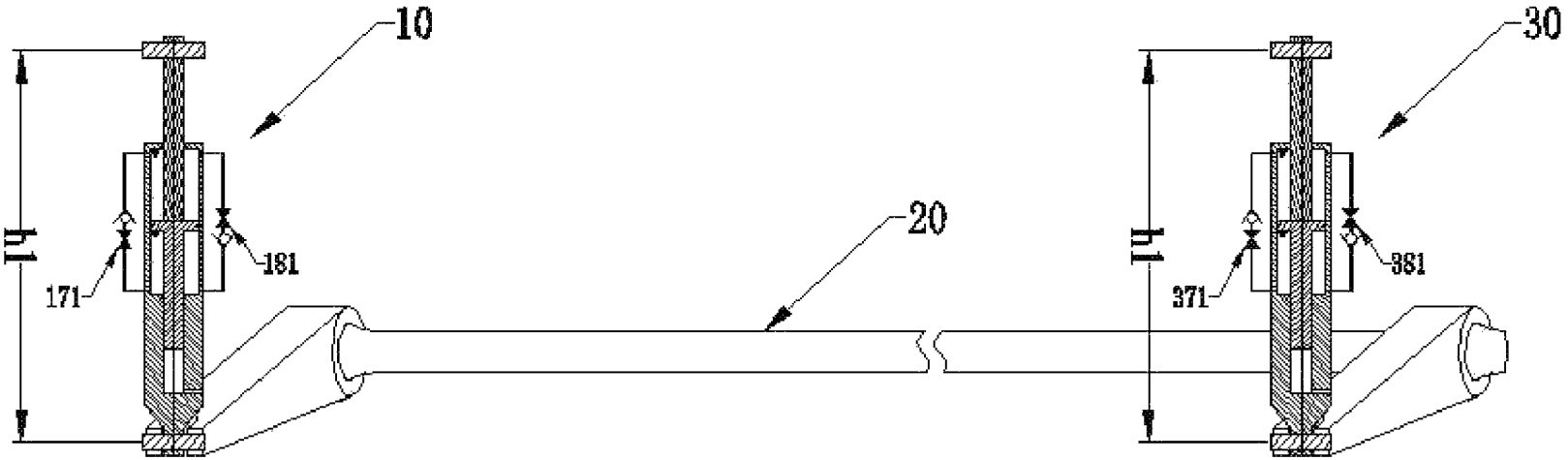
FIG. 12 is a schematic diagram of an adjustable torsion bar system.

The adjustable torsion bar system, as shown in FIG. 12, comprises: a torsion bar 20, a left connecting rod 10 and a right connecting rod 30. The torsion bar 20 is fixed on a bogie/vehicle body; both ends of the torsion bar 20 are hinged with one end of the left connecting rod 10 and the right connecting rod 30 respectively; and the other ends of the left connecting rod 10 and the right connecting rod 30 are hinged with both sides of the vehicle body/bogie respectively. The left connecting rod 10 and the right connecting rod 30 are adjustable hydraulic connecting rods. The length of the connecting rods can be transformed between the states of fixedness and unidirectional follow-up elongation or unidirectional follow-up shortening so that the torsion bar system provides a bidirectional anti-rolling torque or unidirectional anti-rolling torque to satisfy the safety driving requirements of the railway vehicle on different rails.

Figure 3:
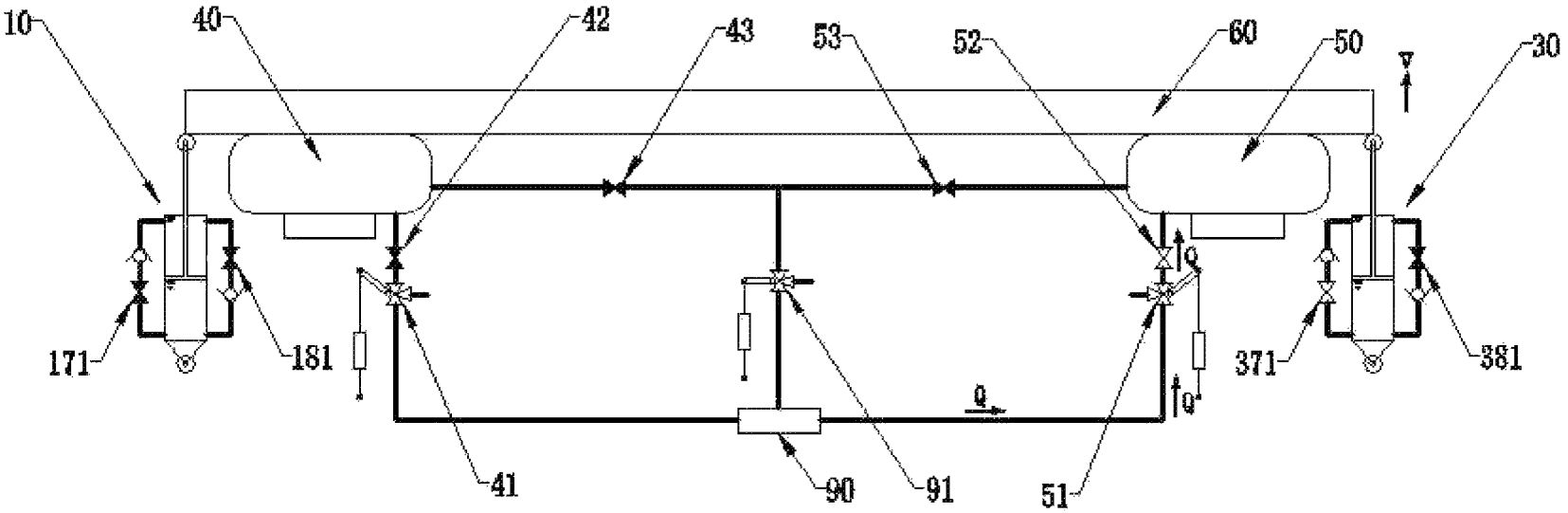
FIG. 3 is a schematic diagram of embodiment 1 when beginning to tilt to the left in a unilateral ascending mode.
Figure 4:
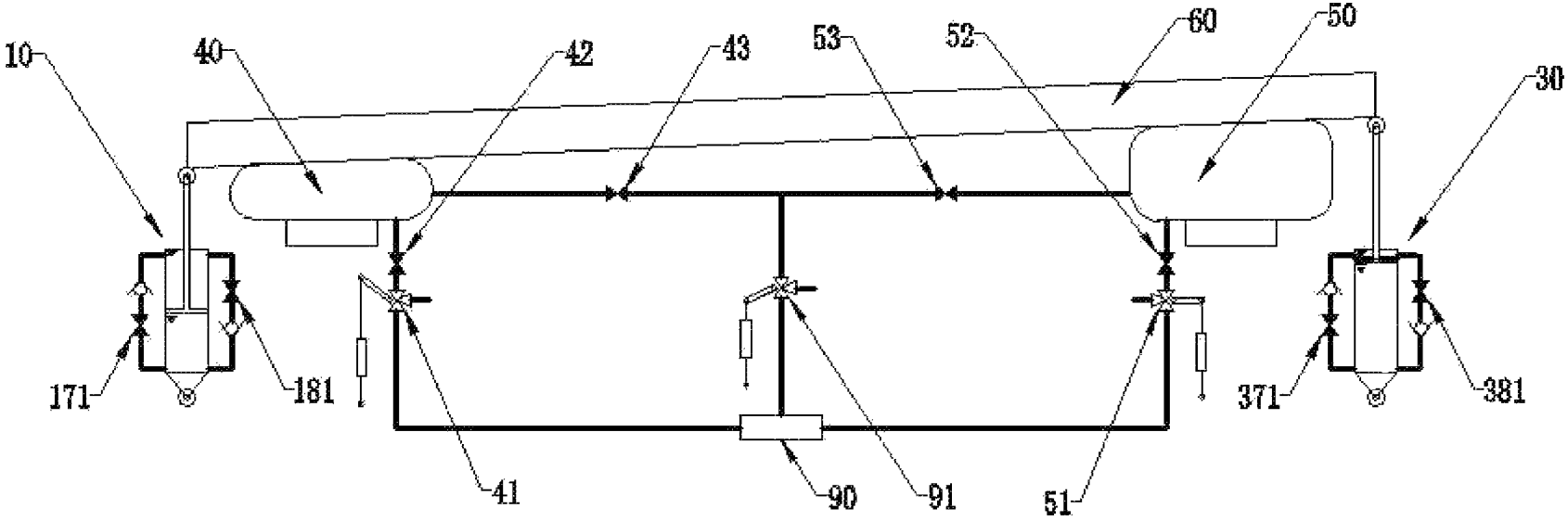
FIG. 4 is a schematic diagram of embodiment 1 when tilting to the left to a position in a unilateral ascending mode.

Embodiment 1 comprises the following steps when adopting a unilateral ascending tilting method for turning left:

Step 1: as shown in FIG. 3 to FIG. 4, when the railway vehicle enters a left-turning transition curve, closing the left air valve II 43 and the right air valve II 53 to prevent the compressed air in the left air spring 40 and the right air spring 50 from venting through the middle height adjusting valve 91; keeping the left air valve I 42 in a closed state and keeping the initial height of the left air spring 40; opening the right air valve I 52, charging the compressed air into the right air spring 50, increasing the height of the right air spring 50, and making the vehicle body 60 tilt to the left; and when the right air spring 50 rises to the preset adjusting height of the right height adjusting valve 51, automatically closing the right height adjusting valve 51 and controlling the raising height of the right air spring 50.

Figure 20:
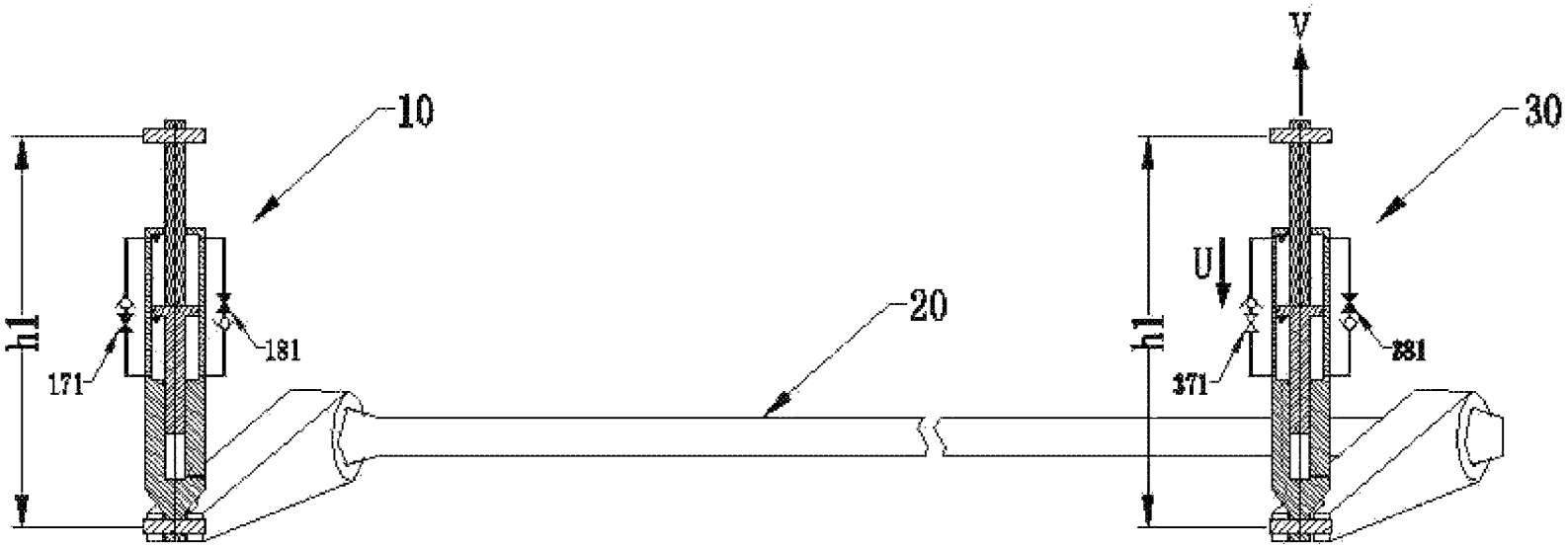
FIG. 20 is a schematic diagram of embodiment 1 when an adjustable torsion bar system begins to tilt to the left in a unilateral ascending mode.
Figure 21:
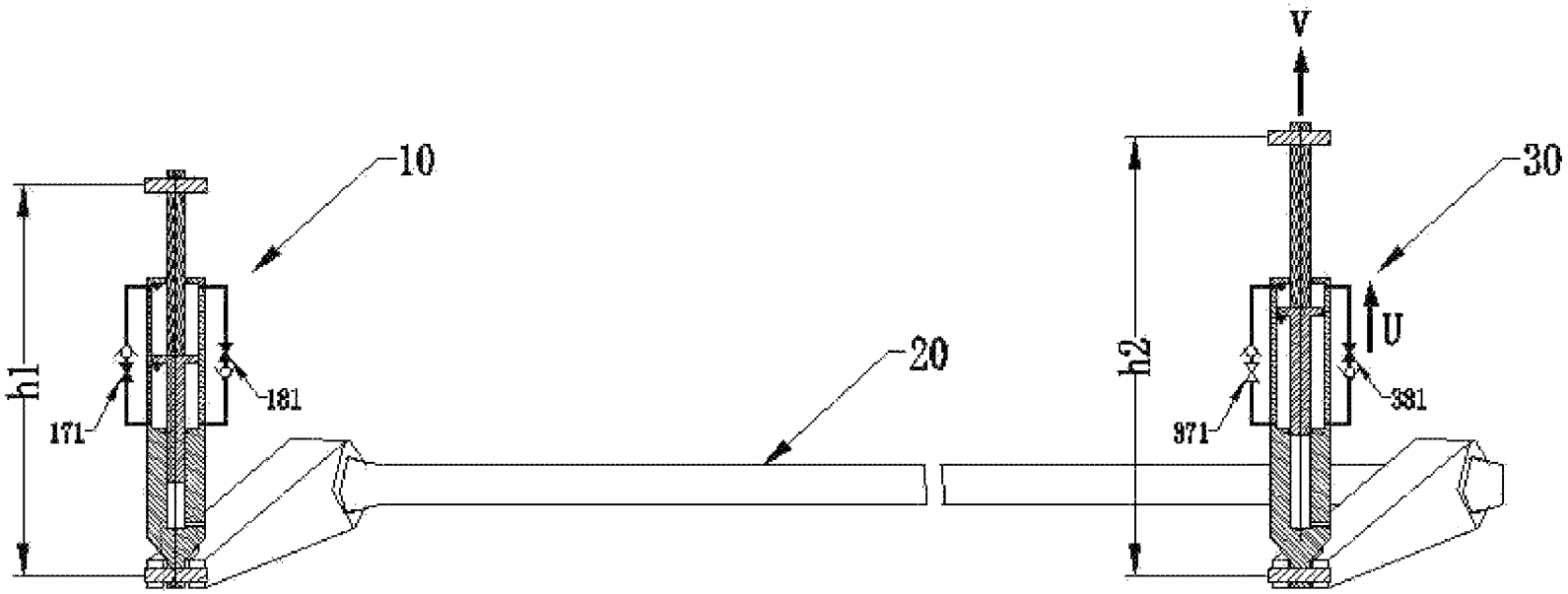
FIG. 21 is a schematic diagram of embodiment 1 when an adjustable torsion bar system tilts to the left to a maximum angle in a unilateral ascending mode.

As shown in FIG. 20 to FIG. 21, when the railway vehicle enters a left-turning transition curve, the lengths of the left connecting rod 10 and the right connecting rod 30 are equal, which are h1. A left straight-through valve I 171 and a left straight-through valve II 181 on the left connecting rod 10 are controlled to be in a disconnected state, and the length of the left connecting rod 10 is kept unchanged; A right straight-through valve I 371 on the right connecting rod 30 is controlled to be in a connected state, a right straight-through valve II 381 is controlled to be in a disconnected state, and the right connecting rod 30 is controlled to be in a unidirectional follow-up elongation state. The railway vehicle actively tilts to the left, and the adjustable torsion bar system is matched with the railway vehicle to tilt to the left. Because the gravity component force after tilting is not enough to balance the centrifugal force, if the railway vehicle rolls to the right due to the influence of the centrifugal force, transverse wind or uneven rail, the left connecting rod 10 cannot be elongated, the right connecting rod 30 cannot be compressed, and the torsion bar 20 is twisted. Thus, a unidirectional anti-rolling torque to prevent the railway vehicle from rolling to the right is generated to prevent the railway vehicle from rolling to the right.

Step 2: as shown in FIG. 4, when the railway vehicle is driven on a main rail on the left-turning curve, closing the right air valve I 52 to prevent the compressed air from entering and leaving the right air spring 50, and keeping the height of the right air spring 50 and the tilting angle β generated by the small tilting system.

As shown in FIG. 21, when the railway vehicle is driven on the main rail on the left-turning curve, the length of the left connecting rod 10 in the adjustable torsion bar system is kept unchanged; and after the right connecting rod 30 is elongated, the length of the right connecting rod is elongated from h1 to h2. At this moment, the left straight-through valve I 171 and the left straight-through valve II 181 on the left connecting rod 10 are controlled to be in a disconnected state, and the length h1 of the left connecting rod 10 is kept unchanged; the right straight-through valve I 371 and the right straight-through valve II 381 on the right connecting rod 30 are controlled to be in a disconnected state, and the length of the right connecting rod 30 is kept as h2. The adjustable torsion bar system provides the bidirectional anti-rolling torque, and no matter the rolling tendency of the railway vehicle to the left or right, the adjustable torsion bar system can prevent the rolling of the railway vehicle to ensure driving safety.

Figure 5:
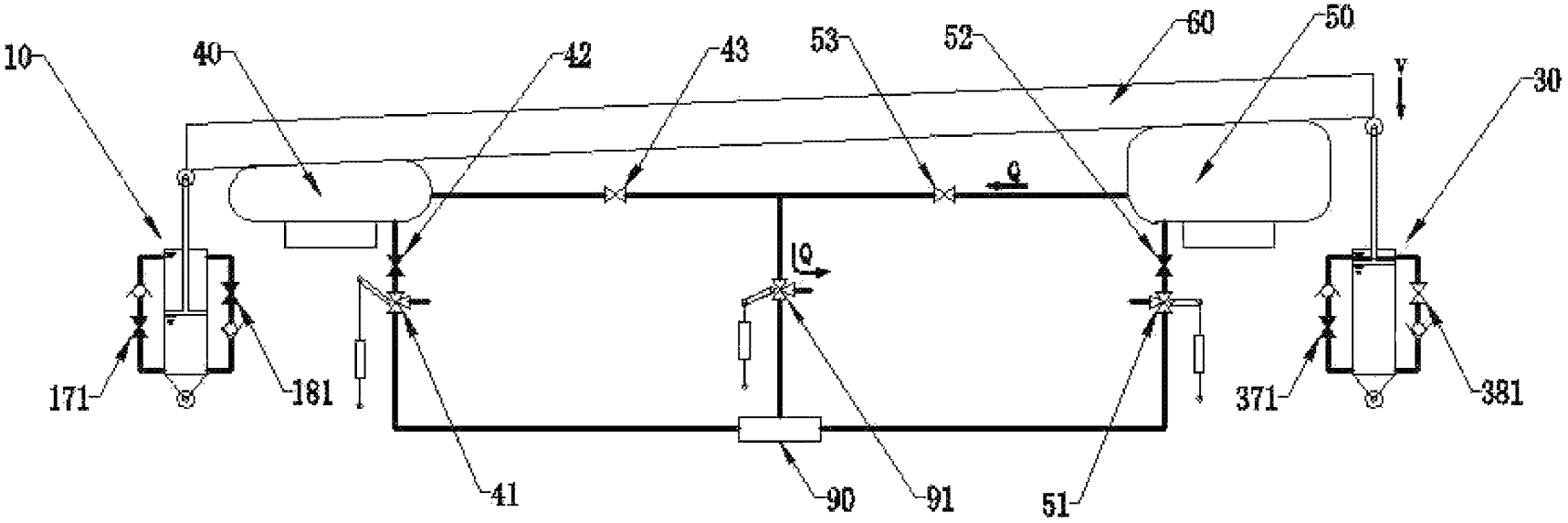
FIG. 5 is a schematic diagram of beginning to reset after the tilt in a unilateral ascending mode in embodiment 1.
Figure 6:
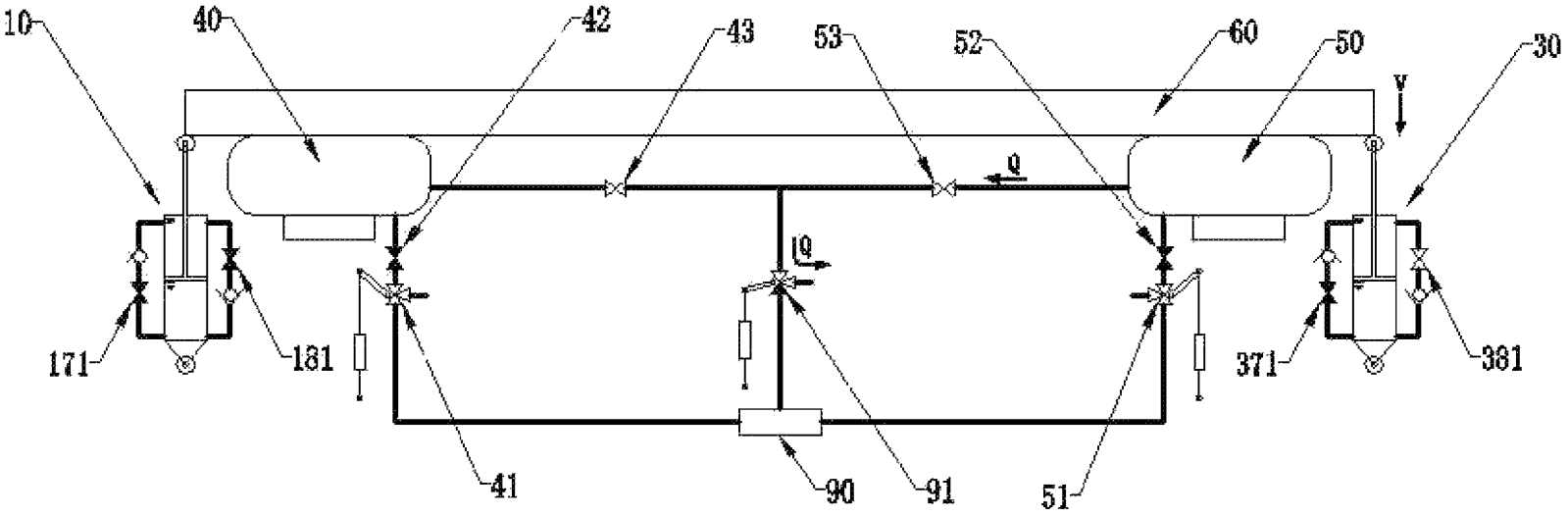
FIG. 6 is a schematic diagram of resetting to an initial height in a unilateral ascending mode in embodiment 1.

Step 3: as shown in FIG. 5 to FIG. 6, when the railway vehicle leaves the main rail on the left-turning curve and enters a left-turning transition curve, opening the left air valve II 43 and the right air valve II 53 to communicate the left air spring 40 with the right air spring 50 for balancing the compressed air in the left air spring 40 and the right air spring 50 and discharging the excessive compressed air through the middle height adjusting valve 91 so that the right air spring 50 is reset to the initial height and the vehicle body 60 ends the tilting state.

Figure 22:
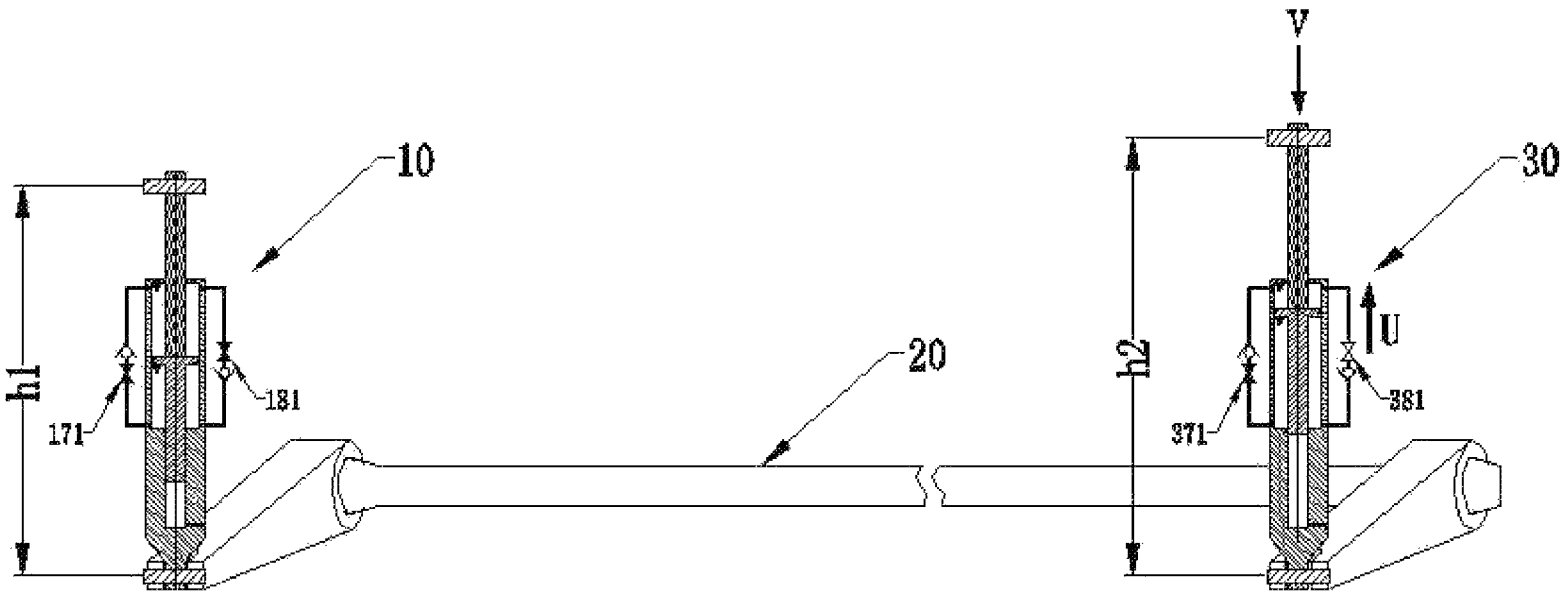
FIG. 22 is a schematic diagram of embodiment 1 when an adjustable torsion bar system begins to reset after tilting to the left in a unilateral ascending mode.
Figure 23:
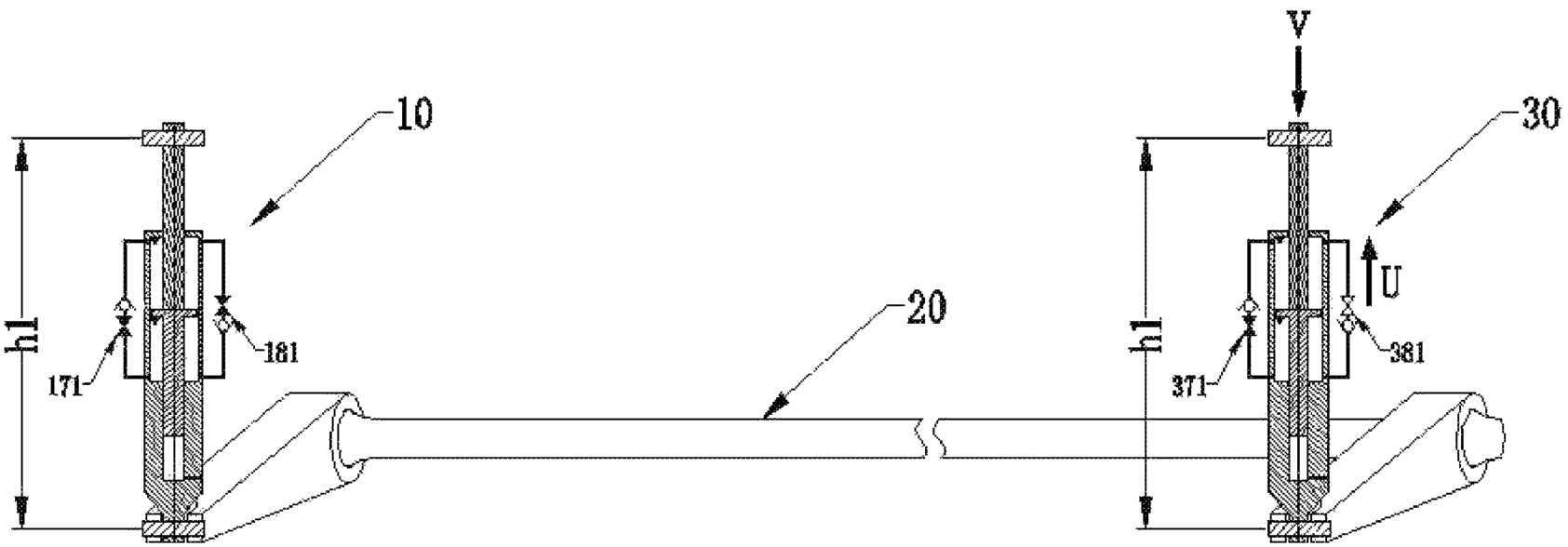
FIG. 23 is a schematic diagram of embodiment 1 when an adjustable torsion bar system resets to an initial position after tilting to the left in a unilateral ascending mode.

As shown in FIG. 22 to FIG. 23, when the railway vehicle leaves the main rail on the left-turning curve and enters a left-turning transition curve, the length of the left connecting rod 10 in the adjustable torsion bar system is kept unchanged; and the right straight-through valve I 371 on the right connecting rod 30 is controlled to be in a disconnected state, the right straight-through valve II 381 is controlled to be in a disconnected state, and the right connecting rod 30 is controlled to be in a unidirectional follow-up shortening state. At this moment, the adjustable torsion bar system provides a left anti-rolling torque only to prevent the railway vehicle from rolling to the left without preventing the railway vehicle from returning to the horizontal state from the left tilting state.

Figure 2:
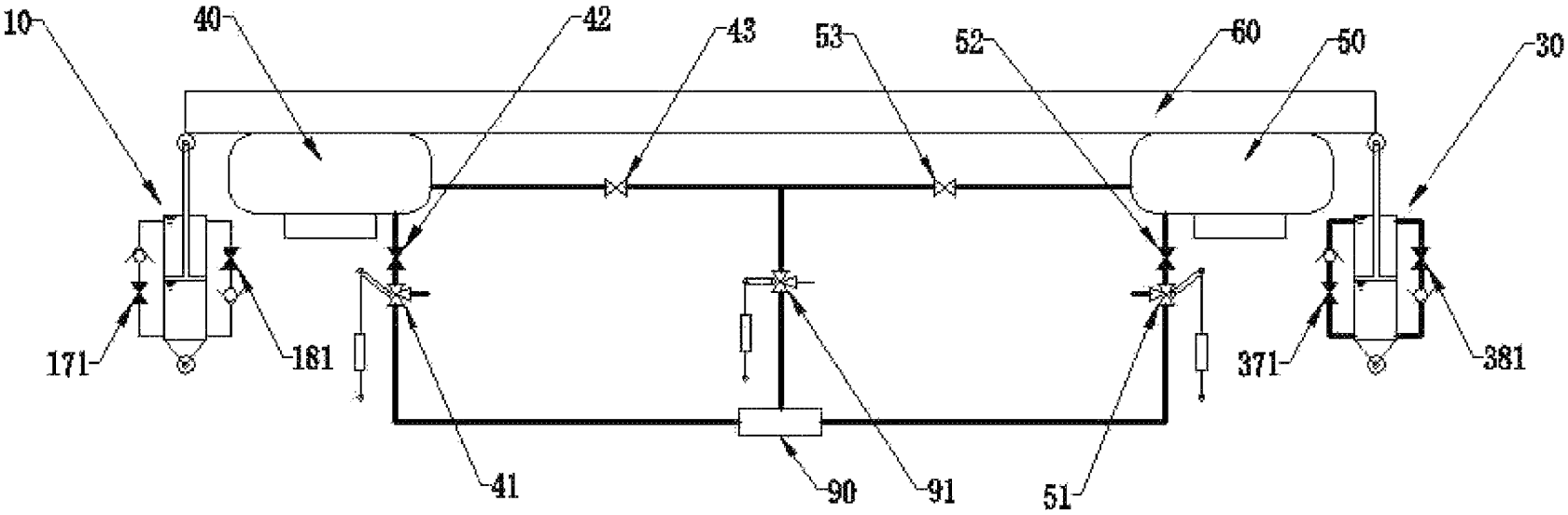
FIG. 2 is a schematic diagram of embodiment 1.

Step 4: as shown in FIG. 2, when the railway vehicle leaves the left-turning transition curve and enters a straight line, keeping the left air valve II 43 and the right air valve II 53 in an opened state and keeping the left air valve I 42 and the right air valve I 52 in a closed state; and adjusting the height through the middle height adjusting valve 91 so that the height is consistent under different loads.

As shown in FIG. 20, when the railway vehicle leaves the left-turning transition curve and enters a straight line, the length of the left connecting rod 10 in the adjustable torsion bar system is kept unchanged; and after the right connecting rod 30 is shortened, the length of the right connecting rod is shortened from h2 to h1. At this moment, the left straight-through valve I 171 and the left straight-through valve II 181 on the left connecting rod 10 are controlled to be in a disconnected state, and the length h1 of the left connecting rod 10 is kept unchanged; the right straight-through valve I 371 and the right straight-through valve II 381 on the right connecting rod 30 are controlled to be in a disconnected state, and the length h1 of the right connecting rod 30 is kept unchanged. At this moment, the adjustable torsion bar system provides the bidirectional anti-rolling torque, and no matter the rolling tendency of the railway vehicle to the left or right, the adjustable torsion bar system can prevent the rolling of the railway vehicle to ensure driving safety.

Embodiment 2 of the present invention, as shown in FIG. 7 to FIG. 11, comprises a small tilting rapid adjusting system and an adjustable torsion bar system, and can adopt a unilateral ascending tilting method or a one-ascending and one-descending tilting method.

The small tilting rapid adjusting system comprises: an air cylinder 90, a left air spring 40, a right air spring 50 and a middle height adjusting valve 91, and further comprises: a left air valve II 43, a left air valve III 44, a left height limiting valve 45, a right air valve II 53, a right air valve III 54 and a right height limiting valve 55; the left air spring 40 is connected with the air cylinder 90 through the left air valve II 43 and the middle height adjusting valve 91, connected with the air cylinder 90 through the left air valve III 44, and deflated through the left height limiting valve 45; and the right air spring 50 is connected with the air cylinder 90 through the right air valve II 53 and the middle height adjusting valve 91, connected with the air cylinder 90 through the right air valve III 54, and deflated through the right height limiting valve 55. The left air valve II 43, the right air valve II 53, the left air valve III 44 and the right air valve III 54 adopt solenoid valves. The diameter of the left air valve III 44 and the right air valve III 54 is greater than 15 mm to accelerate the inflation speed, shorten the time required for tilting, and increase the tilting speed to adapt to the needs of rapidly passing through the curve.

Figure 8:
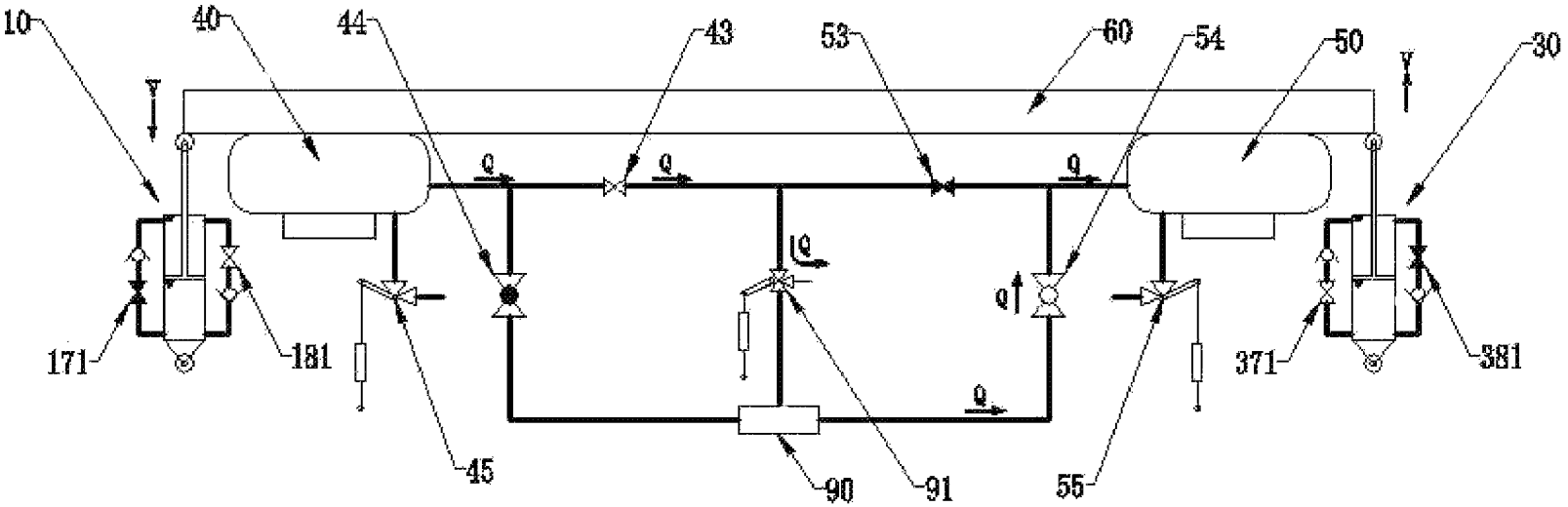
FIG. 8 is a schematic diagram of embodiment 2 when beginning to tilt to the left in a one-ascending and one-descending mode.
Figure 9:
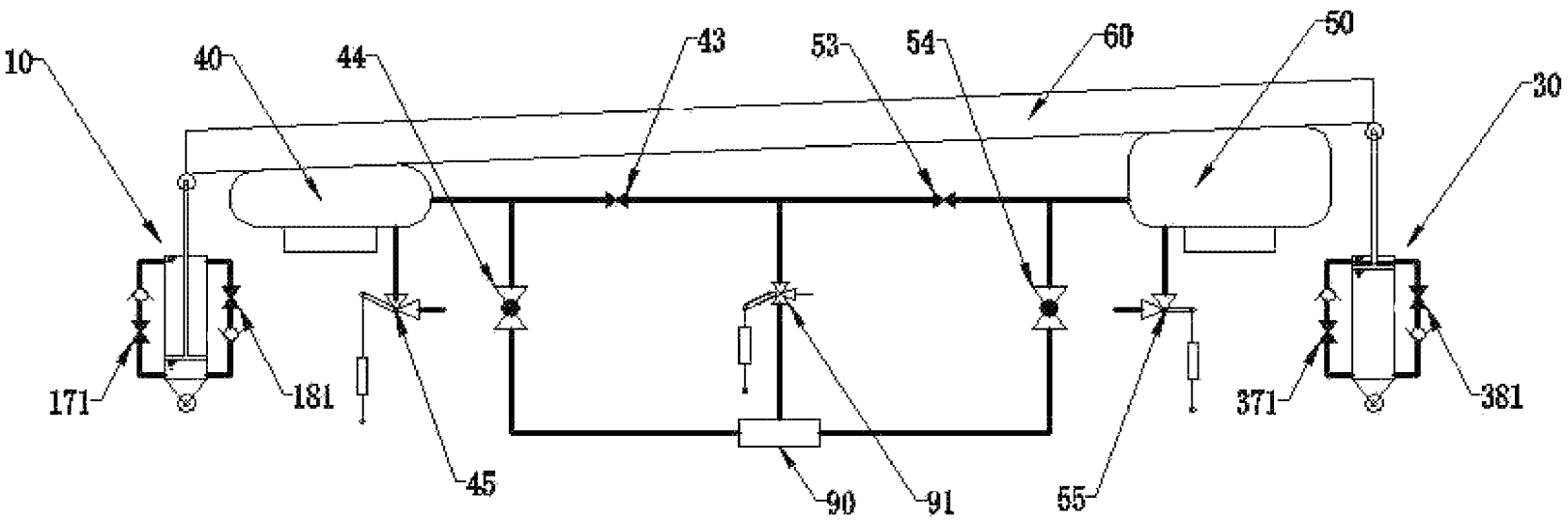
FIG. 9 is a schematic diagram of embodiment 2 when tilting to the left to a position in a one-ascending and one-descending mode.

Embodiment 2 comprises the following steps when adopting a one-ascending and one-descending tilting method for turning left:

Step 1: as shown in FIG. 8 FIG. 9, when the railway vehicle enters a left-turning transition curve, making the left air valve II 43 in a connected state and closing the right air valve II 53; keeping the left air valve III 44 in a closed state, opening the right air valve III 54, charging the compressed air into the right air spring 50, and increasing the height of the right air spring 50; and at this time, making the middle height adjusting valve 91 deviate from a preset balance height in a deflated state. The compressed air in the left air spring 40 is discharged through the left air valve II 43 and the middle height adjusting valve 91, and the height of the left air spring 40 is reduced so that the middle height adjusting valve 91 returns to the preset balance height. When the right spring 50 rises to the preset adjusting height of the height limiting valve 55, the right spring 50 ascends and the left spring 40 descends. The preset balance height of the middle height adjusting valve 91 is used as a basis to achieve dynamic balance and make the vehicle body 60 tilt to the left; when the right air spring 50 rises beyond the preset adjusting height of the right height limiting valve 55, the compressed air is discharged through the right height adjusting valve 55, and the closing of the right air valve III 54 is delayed according to the time required for the tilting action obtained by the test; and at this moment, the tilting action is completed.

Figure 24:
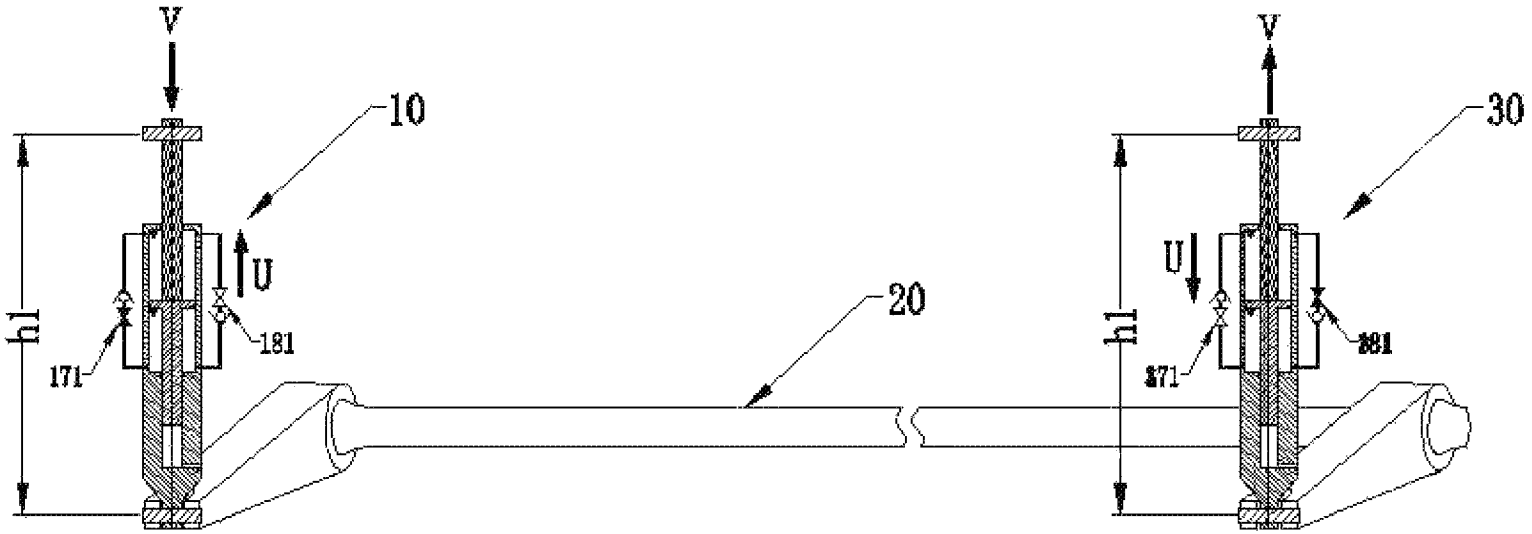
FIG. 24 is a schematic diagram of embodiment 2 when an adjustable torsion bar system begins to tilt to the left in a one-ascending and one-descending mode.
Figure 25:
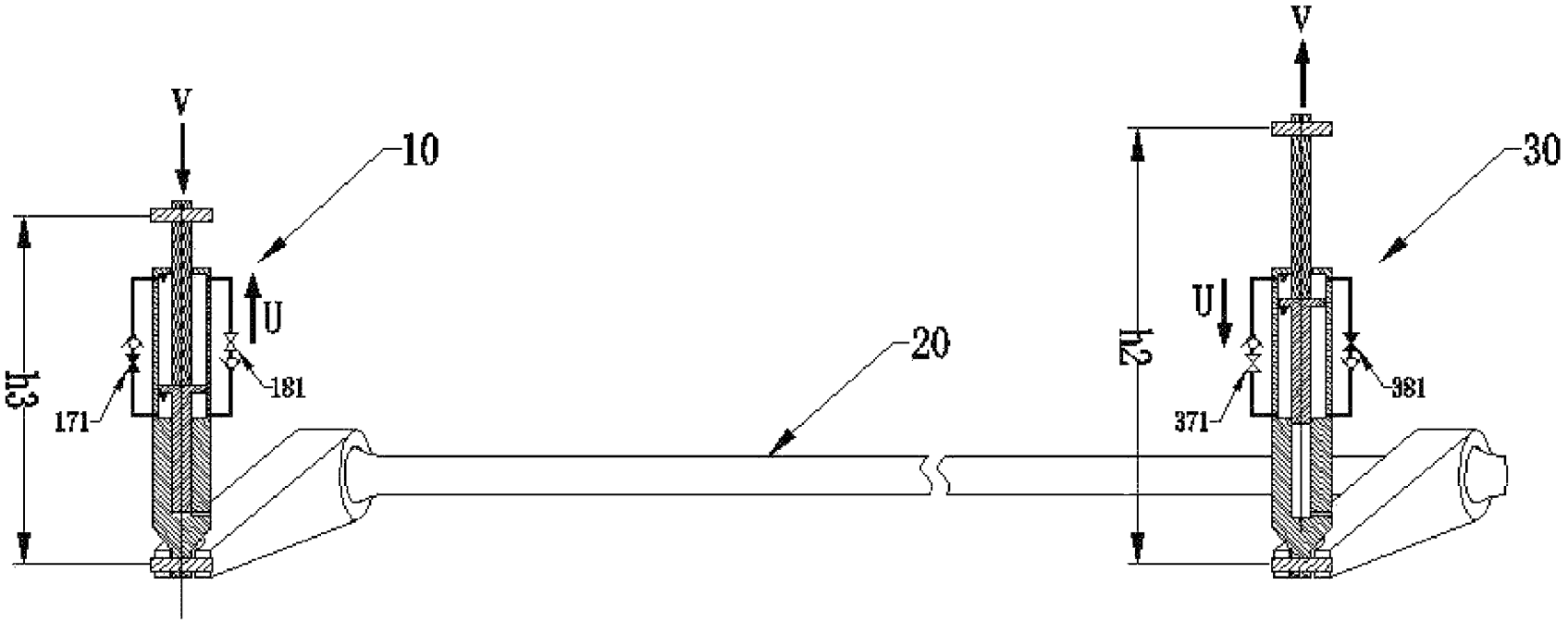
FIG. 25 is a schematic diagram of embodiment 2 when an adjustable torsion bar system tilts to the left to a maximum angle in a one-ascending and one-descending mode.

As shown in FIG. 24 to FIG. 25, when the railway vehicle enters a left-turning transition curve, the lengths of the left connecting rod 10 and the right connecting rod 30 are equal, which are h1. A left straight-through valve I 171 on the left connecting rod 10 is controlled to be in a disconnected state, a left straight-through valve II 181 is controlled to be in a connected state, and the left connecting rod 10 is controlled to be in a unidirectional follow-up shortening state. A right straight-through valve I 371 on the right connecting rod 30 is controlled to be in a connected state, a right straight-through valve II 381 is controlled to be in a disconnected state, and the right connecting rod 30 is controlled to be in a unidirectional follow-up elongation state. As the railway vehicle actively tilts to the left, the left connecting rod 10 in the adjustable torsion bar system conducts unidirectional follow-up contraction with the left tilting of the railway vehicle, and the right connecting rod 30 conducts unidirectional follow-up elongation with the left tilting of the railway vehicle. The adjustable torsion bar system is matched with the railway vehicle for tilting to the left. At this time, the adjustable torsion bar system keeps a unidirectional anti-rolling state, provides a unidirectional anti-rolling torque to prevent the railway vehicle from rolling to the right, and prevents the railway vehicle from rolling to the right.

Step 2: as shown in FIG. 9, when the railway vehicle is driven on a main rail on the left-turning curve, closing the air valve II 43, delaying the closing of the right air valve III 54, preventing the compressed air in the left air spring 40 and the right air spring 50 from entering and leaving, and keeping the height of the left air spring 40 and the right air spring 50 and the tilting angle β generated by the small tilting system.

As shown in FIG. 25, when the railway vehicle is driven on the main rail on the left-turning curve, the length of the left connecting rod 10 is shortened from h1 to h3 after the left connecting rod 10 in the adjustable torsion bar system is contracted; and after the right connecting rod 30 is elongated, the length of the right connecting rod 30 is elongated from h1 to h2. At this moment, the left straight-through valve I 171 and the left straight-through valve II 181 on the left connecting rod 10 are controlled to be in a disconnected state, and the length h3 of the left connecting rod 10 is kept unchanged; and the right straight-through valve I 371 and the right straight-through valve II 381 on the right connecting rod 30 are controlled to be in a disconnected state, and the length h2 of the right connecting rod 30 is kept unchanged. At this moment, the adjustable torsion bar system provides the bidirectional anti-rolling torque, and no matter the rolling tendency of the railway vehicle to the left or right, the adjustable torsion bar system can prevent the rolling of the railway vehicle to ensure driving safety.

Figure 10:
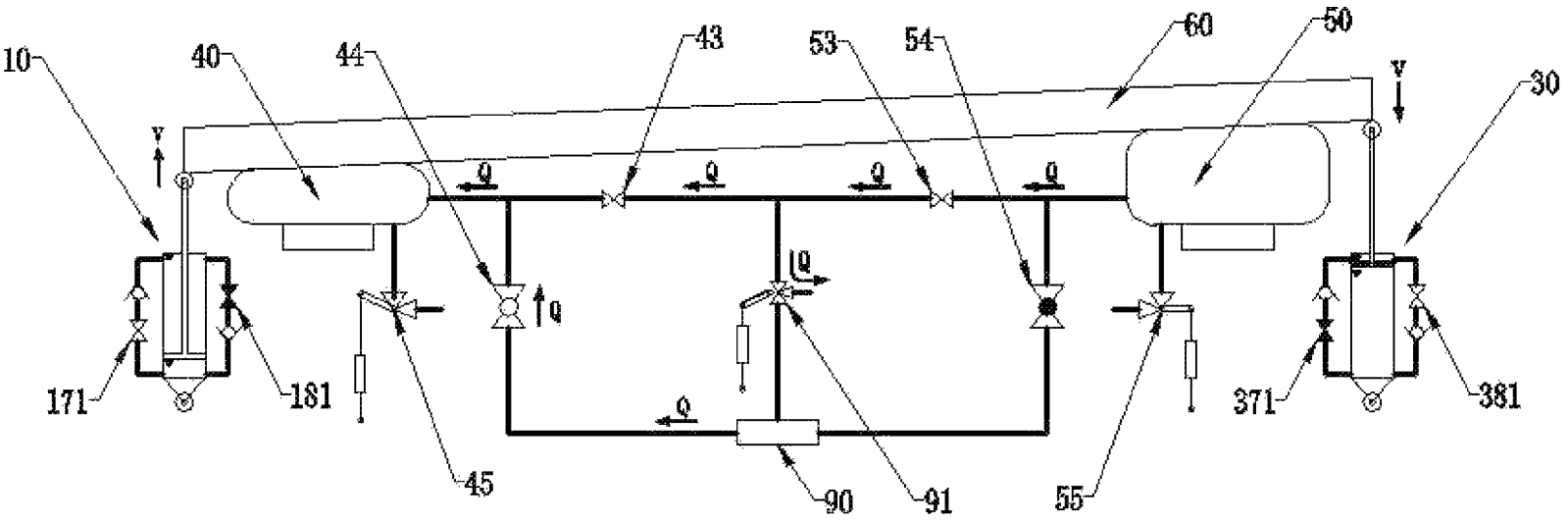
FIG. 10 is a schematic diagram of beginning to reset after the tilt in a one-ascending and one-descending mode in embodiment 2.
Figure 11:
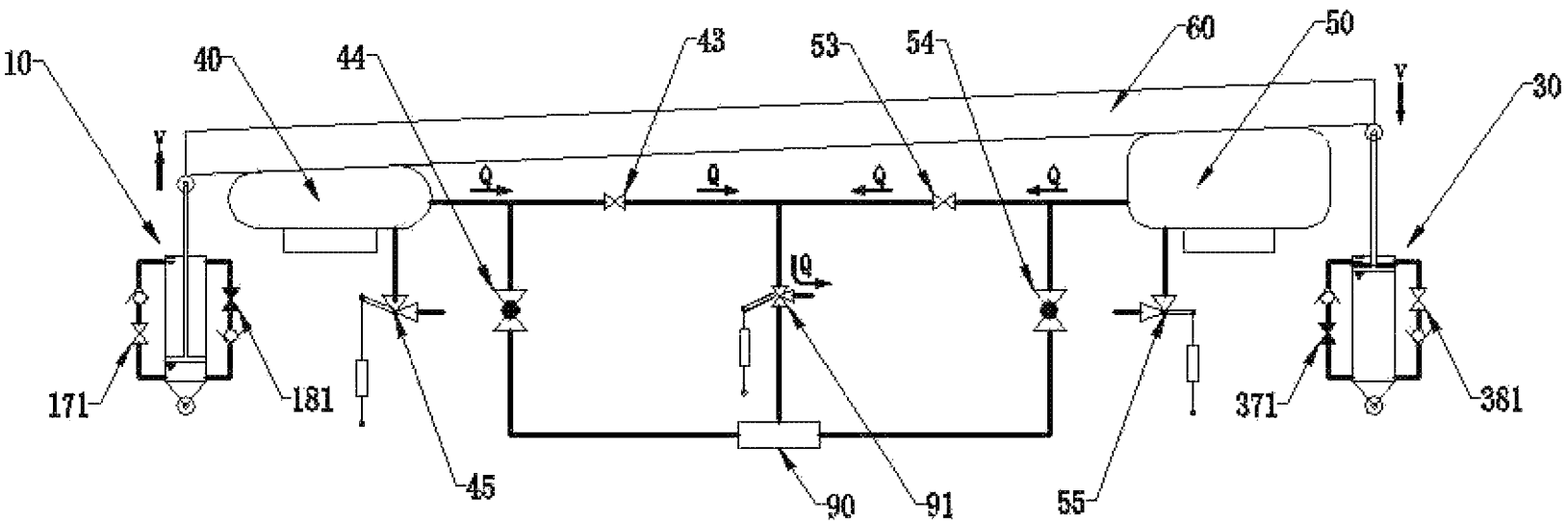
FIG. 11 is a schematic diagram of resetting to an initial height in a one-ascending and one-descending mode in embodiment 2.

Step 3: as shown in FIG. 10 to FIG. 11, when the railway vehicle leaves the main rail on the left-turning curve and enters a left-turning transition curve, opening the left air valve III 44, charging compressed air into the left air spring 40 through the left air valve III 44 and increasing the height of the left air spring 40; meanwhile, opening the left air valve II 43 and the right air valve II 53 to communicate the left air spring 40 with the right air spring 50 for balancing the compressed air in the left air spring 40 and the right air spring 50 and discharging the excessive compressed air through the middle height adjusting valve 91 so that the left air spring 40 and the right air spring 50 are reset to the initial height and the vehicle body 60 ends the tilting state.

Figure 26:
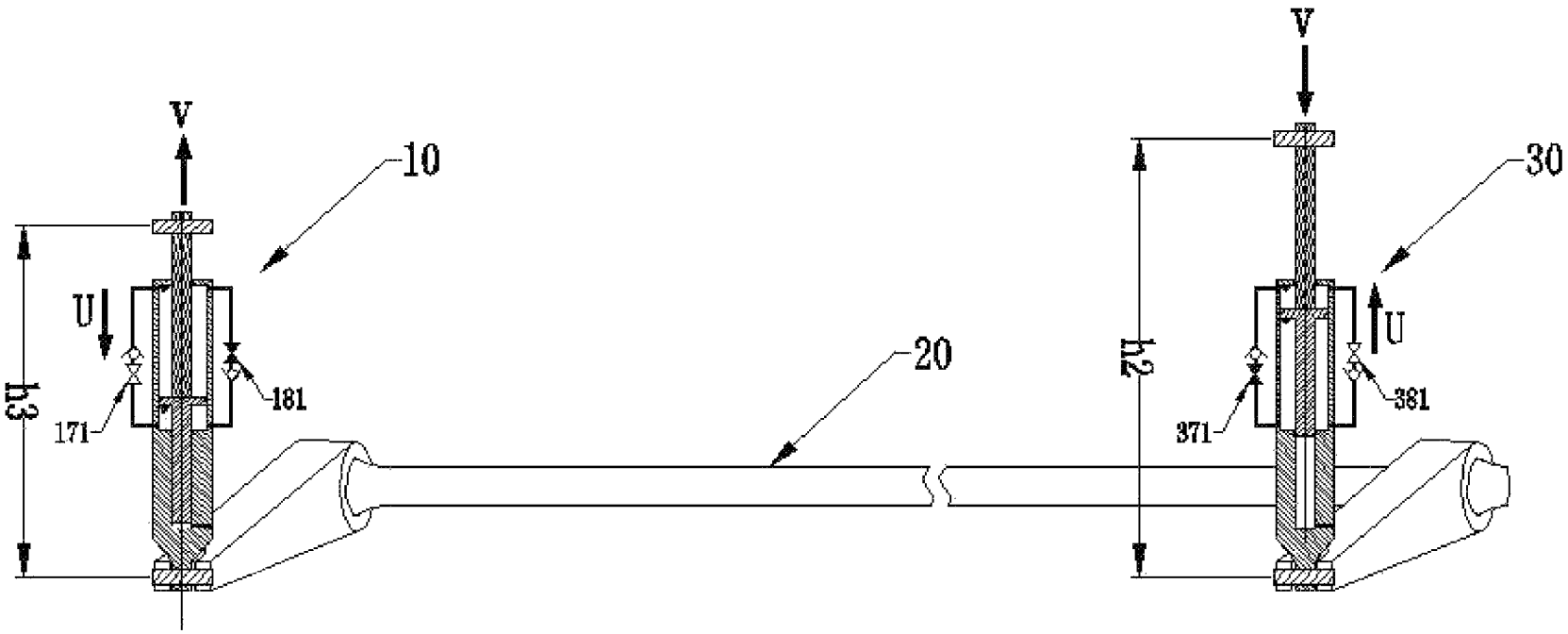
FIG. 26 is a schematic diagram of embodiment 2 when an adjustable torsion bar system begins to reset after tilting to the left in a one-ascending and one-descending mode.
Figure 27:
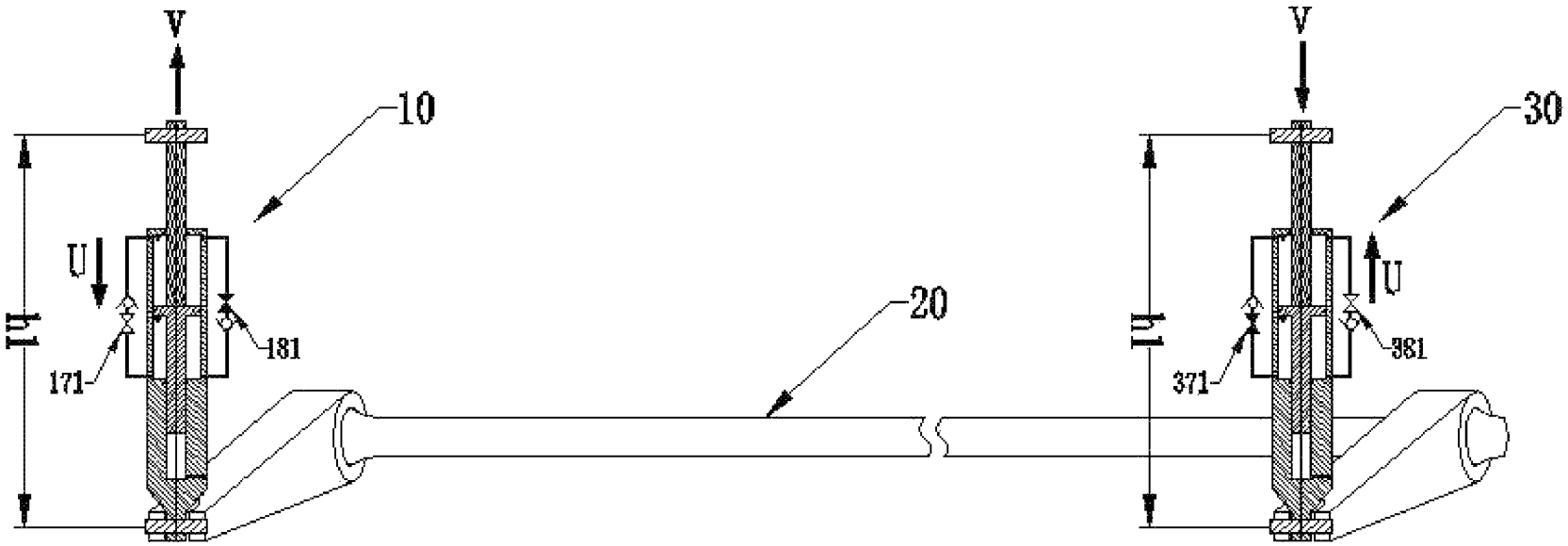
FIG. 27 is a schematic diagram of embodiment 2 when an adjustable torsion bar system resets to an initial position after tilting to the left in a one-ascending and one-descending mode.

As shown in FIG. 26 to FIG. 27, when the railway vehicle leaves the main rail on the left-turning curve and enters a left-turning transition curve, the left straight-through valve I 171 on the left connecting rod 10 is controlled to be in a connected state, the left straight-through valve II 181 is controlled to be in a disconnected state, and the left connecting rod 10 is controlled to be in a unidirectional follow-up elongation state; and the right straight-through valve I 371 on the right connecting rod 30 is controlled to be in a disconnected state, the right straight-through valve II 381 is controlled to be in a disconnected state, and the right connecting rod 30 is controlled to be in a unidirectional follow-up shortening state. At this moment, the adjustable torsion bar system provides a left anti-rolling torque only to prevent the railway vehicle from rolling to the left without preventing the railway vehicle from returning to the horizontal state from the left tilting state.

Figure 7:
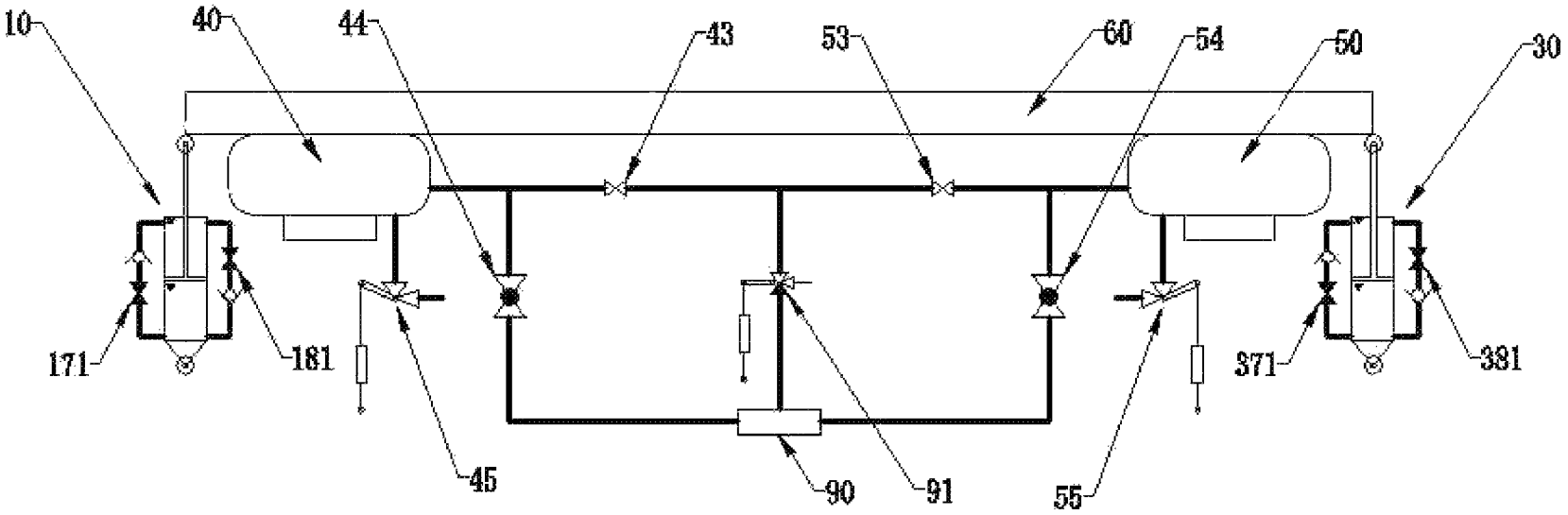
FIG. 7 is a schematic diagram of embodiment 2.

Step 4: as shown in FIG. 7, when the railway vehicle leaves the left-turning transition curve and enters a straight line, keeping the left air valve III 44 and the right air valve III 54 closed and keeping the left air valve II 43 and the right air valve II 53 connected; and adjusting the height through the middle height adjusting valve 91 so that the height is consistent under different loads.

As shown in FIG. 24, when the railway vehicle leaves the left-turning transition curve and enters a straight line, after the connecting rod 10 is elongated, the length of the left connecting rod is elongated from h3 to h1; and after the right connecting rod 30 is shortened, the length of the right connecting rod is shortened from h2 to h1. At this moment, the left straight-through valve I 171 and the left straight-through valve II 181 on the left connecting rod 10 are controlled to be in a disconnected state, and the length h1 of the left connecting rod 10 is kept unchanged; the right straight-through valve I 371 and the right straight-through valve II 381 on the right connecting rod 30 are controlled to be in a disconnected state, and the length h1 of the right connecting rod 30 is kept unchanged. At this moment, the adjustable torsion bar system provides the bidirectional anti-rolling torque, and no matter the rolling tendency of the railway vehicle to the left or right, the adjustable torsion bar system can prevent the rolling of the railway vehicle to ensure driving safety.

Figure 13:
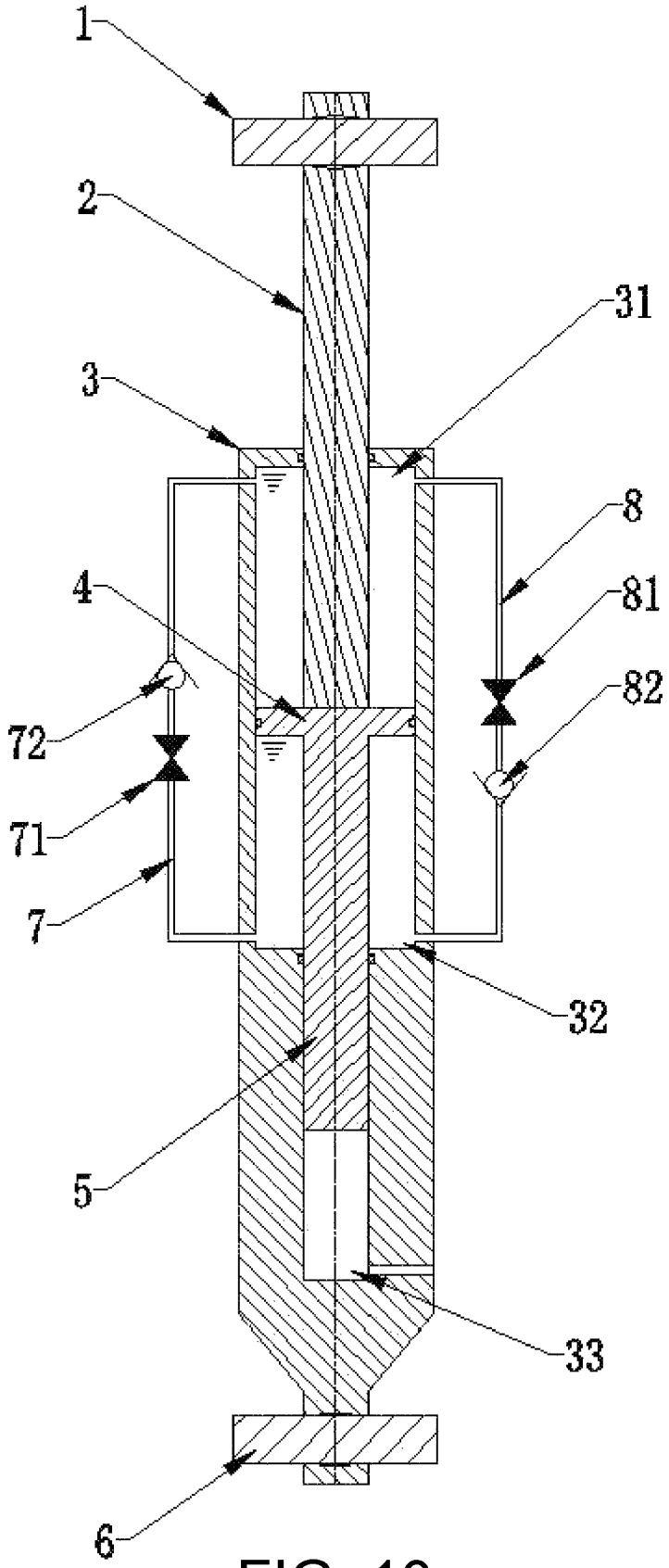
FIG. 13 is a schematic diagram when the length of a hydraulic connecting rod is locked and unchanged.

The hydraulic connecting rod is shown in FIG. 13: the hydraulic connecting rod comprises: a rod body 3, a piston 4 and a control component; the piston 4 is movably arranged in the rod body 3; the rod body 3 is divided into a liquid cavity I 31 and a liquid cavity II 32; the liquid cavity I 31 and the liquid cavity II 32 are filled with liquid media; the liquid cavity I 31 is connected with the liquid cavity II 32 through a flow channel I 7 and a flow channel II 8; a straight-through valve I 71 and a check valve I 72 are arranged on the flow channel I 7; the liquid media in the liquid cavity I 31 can only flow to the liquid cavity II 32 through the check valve I 72 and the straight-through valve I 71; a straight-through valve II 81 and a check valve II 82 are arranged on the flow channel II 8; and the liquid media in the liquid cavity II 32 can only flow to the liquid cavity I 31 through the check valve II 82 and the straight-through valve II 81. By controlling the unidirectional flow of the liquid media, the length of the connecting rods can realize unidirectional follow-up elongation or unidirectional follow-up shortening.

Figure 14:
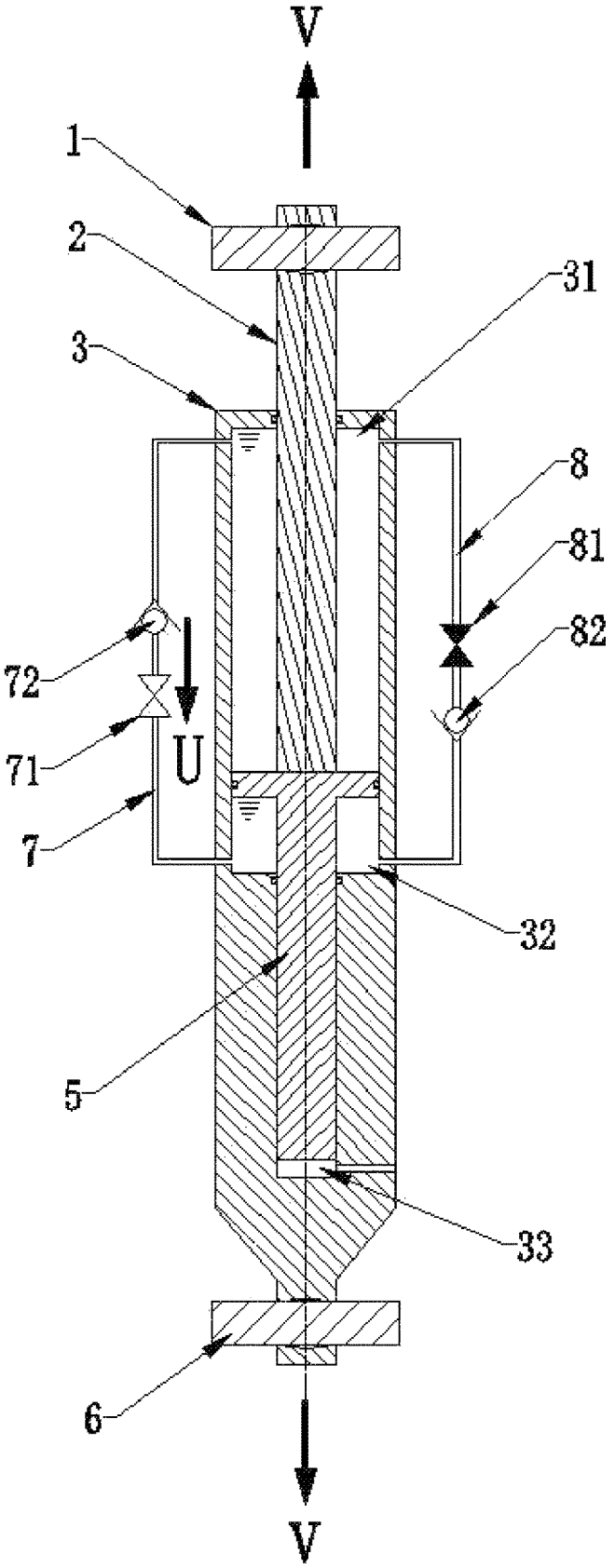
FIG. 14 is a schematic diagram 1 in unidirectional follow-up elongation of a hydraulic connecting rod.
Figure 15:
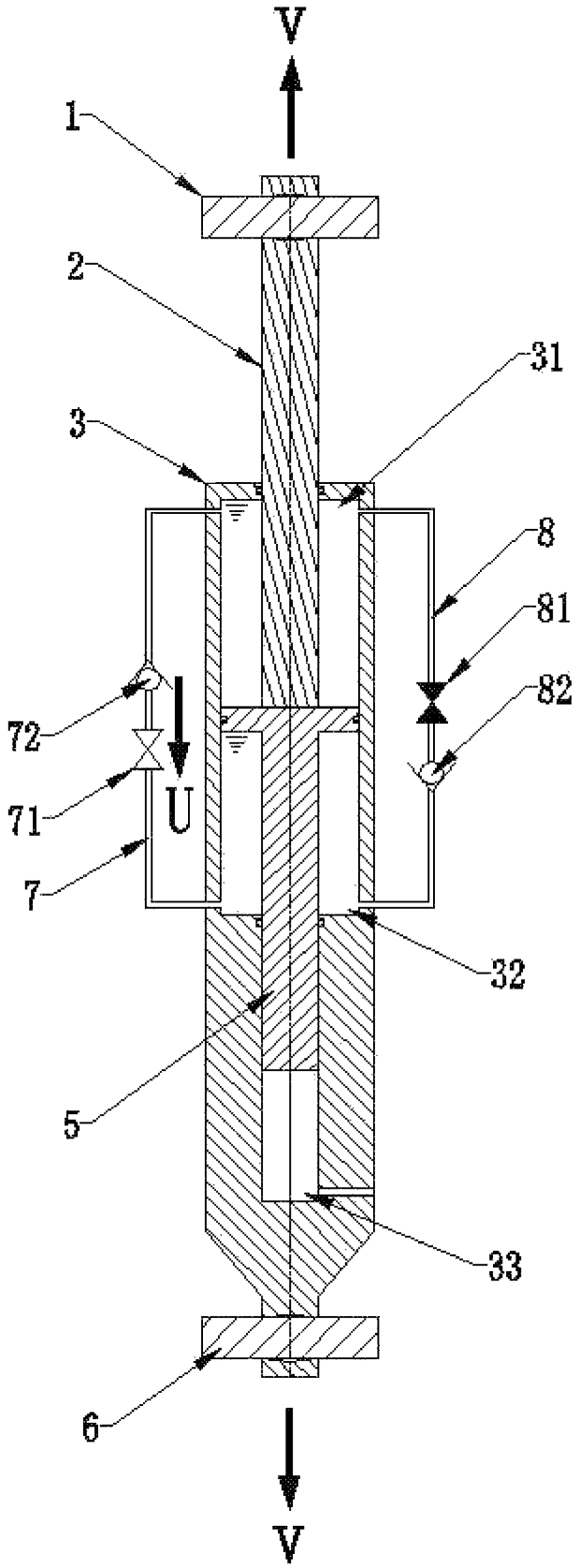
FIG. 15 is a schematic diagram 2 in unidirectional follow-up elongation of a hydraulic connecting rod.
Figure 16:
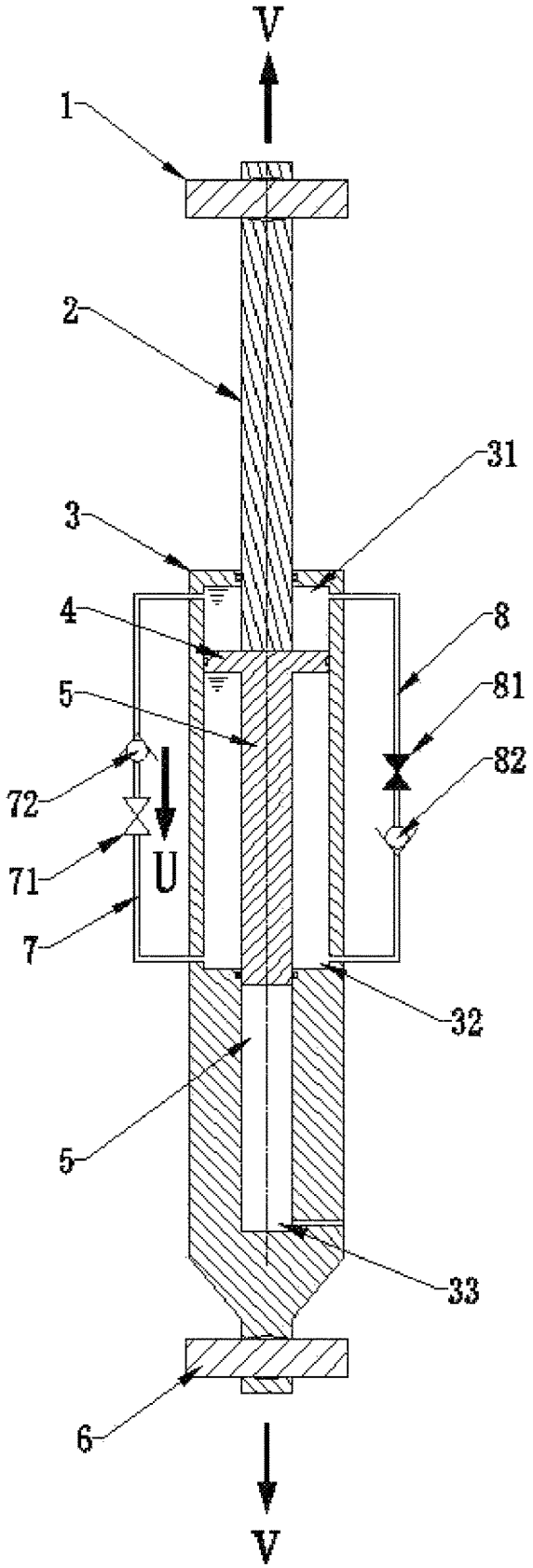
FIG. 16 is a schematic diagram 3 in unidirectional follow-up elongation of a hydraulic connecting rod.

The unidirectional follow-up elongation of the hydraulic connecting rod is shown in FIG. 14 to FIG. 16: when the straight-through valve I 71 is connected and the straight-through valve II 81 is disconnected, the liquid media in the liquid cavity I 31 can only flow to the liquid cavity II 32 through the flow channel I 7, and the length of the connecting rod is freely elongated under the action of tension; and when the tension is converted into pressure, the liquid media in the liquid cavity II 32 cannot flow to the liquid cavity I 31, the length of the connecting rod remains unchanged, and the hydraulic connecting rod is in a state of unidirectional follow-up elongation.

Figure 17:
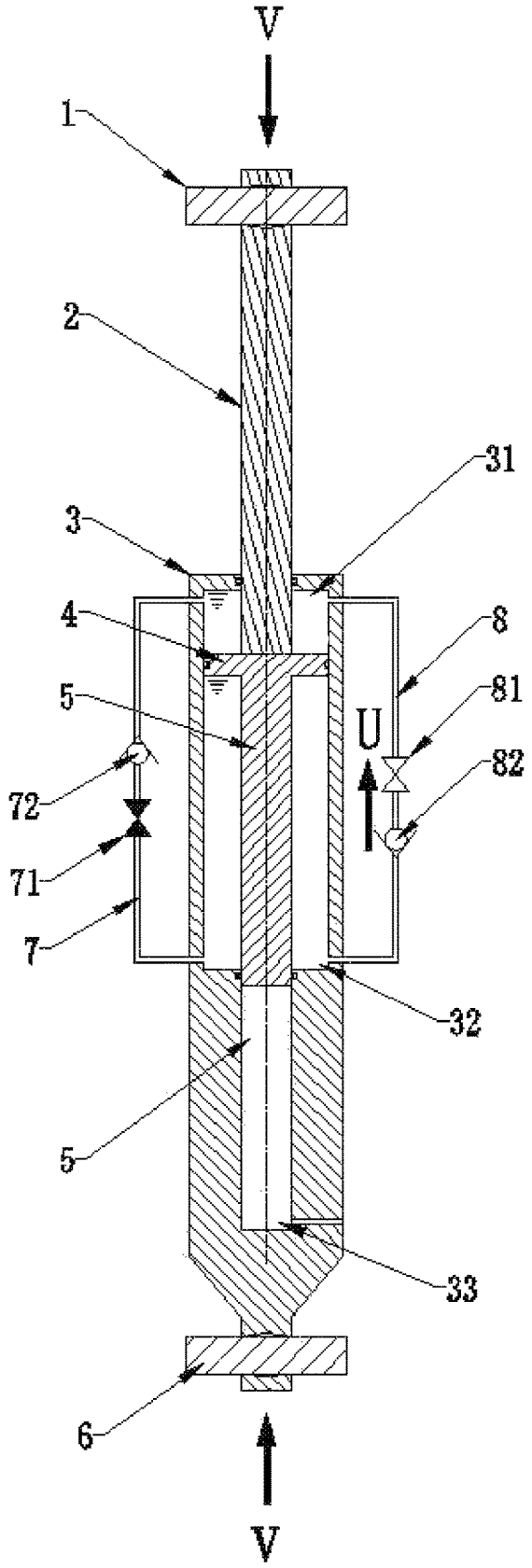
FIG. 17 is a schematic diagram 1 in unidirectional follow-up shortening of a hydraulic connecting rod.
Figure 18:
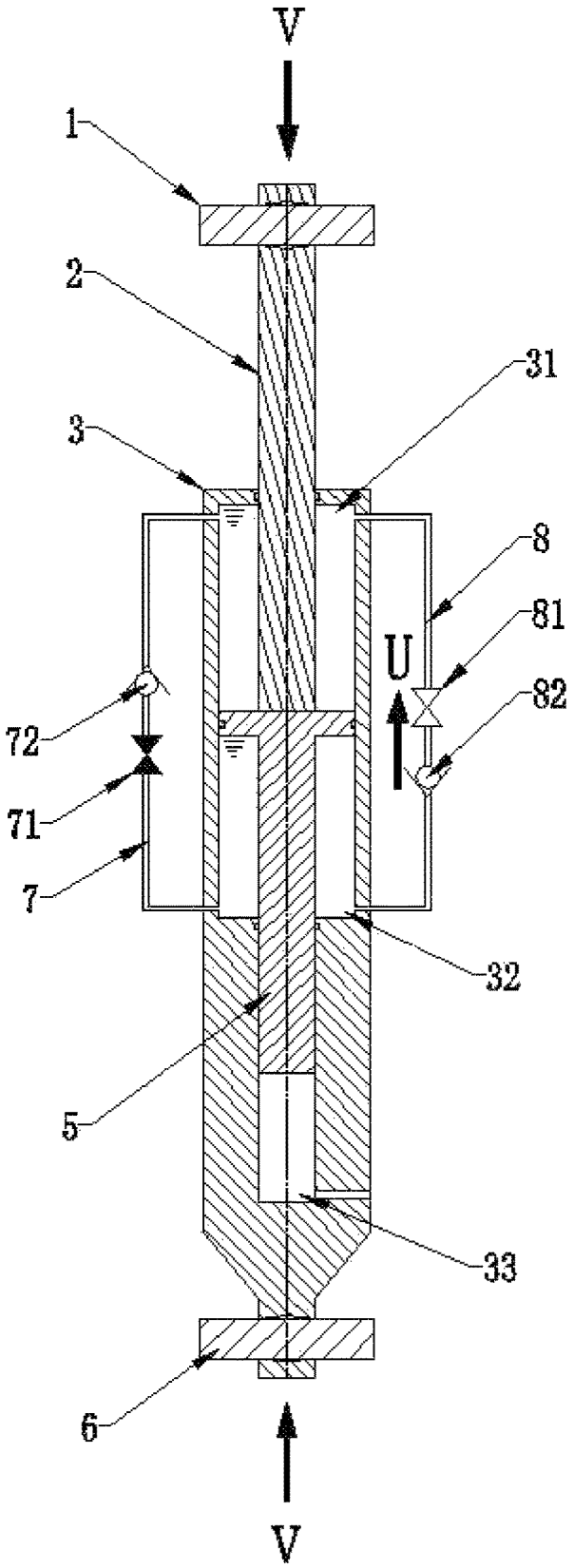
FIG. 18 is a schematic diagram 2 in unidirectional follow-up shortening of a hydraulic connecting rod.
Figure 19:
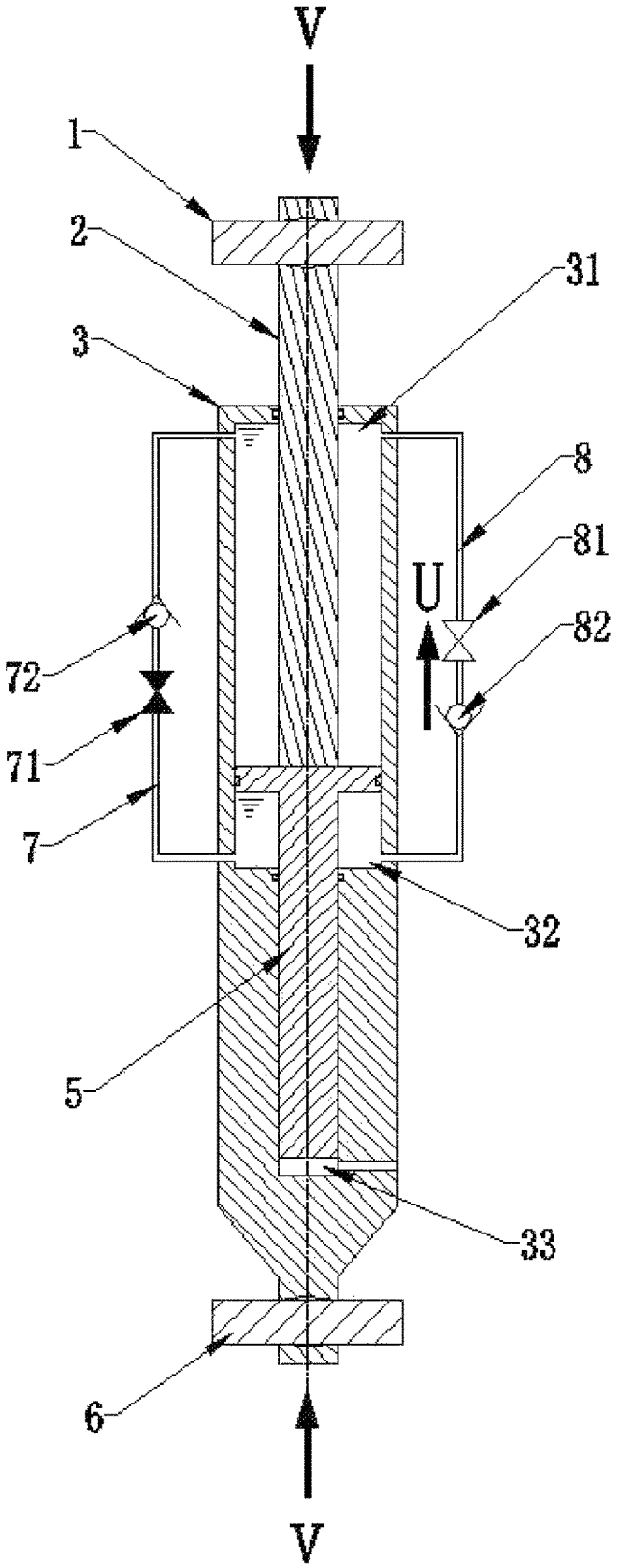
FIG. 19 is a schematic diagram 3 in unidirectional follow-up shortening of a hydraulic connecting rod.

The unidirectional follow-up shortening of the hydraulic connecting rod is shown in FIG. 17 to FIG. 19: when the straight-through valve I 71 is disconnected and the straight-through valve II 81 is connected, the liquid media in the liquid cavity II 32 can only flow to the liquid cavity I 31 through the flow channel II 8, and the length of the connecting rod is freely shortened under the action of pressure; and when the pressure is converted into tension, the liquid media in the liquid cavity I 31 cannot flow to the liquid cavity II 32, the length of the connecting rod remains unchanged, and the hydraulic connecting rod is in a state of unidirectional follow-up shortening.

In conclusion, the present invention has the following beneficial effects: when the railway vehicle is driven on the curve, the compressed air that enters the air springs on both sides of the railway vehicle are controlled to generate a height difference on the air springs on both sides so that the railway vehicle realizes small tilting toward the inner side of the curve to increase the curve driving speed of the railway vehicle. The adjustable torsion bar system is controlled to provide the bidirectional anti-rolling torque or unidirectional anti-rolling torque to satisfy the safety driving requirements of the railway vehicle on different rails. On the basis of the existing railway vehicle structure, a slight reformation of the railway vehicle is only needed in the present application to make the railway vehicle body generate the maximum tilting angle of 3°, so that the speed increase can reach 10-20%, which has the advantages of simple structure and low cost, has good economy and practicality, and is suitable for the transformation and large-scale promotion of the existing railway vehicles.

The above embodiments are merely used for illustration of the present invention, and not intended to limit the present invention. Various changes or transformations can also be made by those skilled in the art without departing from the spirit and the scope of the present invention. Therefore, all equivalent technical solutions shall also belong to the protection scope of the present invention, and the protection scope of the present invention shall be defined by the claims.

What is claimed is:

1. A method for improving a curvilinear running speed of a railway vehicle, wherein when the railway vehicle is driven on a curve, raising and falling of air springs on both sides of the railway vehicle are controlled by a control assembly to realize tilting of the railway vehicle toward an inner side of the curve; a transverse component of gravity after the tilting of the railway vehicle is used for balancing part of a centrifugal force and reducing an influence of the centrifugal force, thereby improving a curve driving speed of the railway vehicle; and meanwhile, an adjustable torsion bar system is controlled to provide a unidirectional anti-rolling torque for preventing the railway vehicle from rolling toward an outer side of the curve without hindering the railway vehicle from tilting slightly toward the inner side of the curve, so as to ensure driving safety of the railway vehicle on the curve, wherein when the railway vehicle enters a transition curve, the adjustable torsion bar system is controlled to be in a unidirectional anti-rolling state, and the adjustable torsion bar system does not prevent the railway vehicle from tilting to the inner side of the curve; once the railway vehicle has a tendency to roll to the outer side of the curve, the adjustable torsion bar system provides the unidirectional anti-rolling torque to prevent the railway vehicle from rolling to the outer side of the curve, wherein the adjustable torsion bar system comprises: a torsion bar and two hydraulic connecting rods; the torsion bar is fixed on a bogie or a vehicle body; two ends of the torsion bar are hinged with one end of each of the two hydraulic connecting rods respectively; another end of each of the two hydraulic connecting rods is hinged with two sides of the vehicle body or the bogie respectively; a length of the two hydraulic connecting rods is capable of being transformed between a fixing state, a unidirectional follow-up elongation only state, or a unidirectional follow-up shortening only state, so that the adjustable torsion bar system provides a bidirectional anti-rolling torque or the unidirectional anti-rolling torque, and wherein when the railway vehicle enters the transition curve, a length of one of the two hydraulic connecting rods on the inner side of the curve is controlled to be locked and unchanged or in a unidirectional follow-up shortening state; another one of the two hydraulic connecting rods on the outer side of the curve is controlled to be in a unidirectional follow-up elongation state; when the railway vehicle inclines to the inner side of the curve, the length of the one of the two hydraulic connecting rods on the inner side of the curve is locked and unchanged or shortened with the tilting of the railway vehicle; the another one of the two hydraulic connecting rods on the outer side of the curve extends with a swing of the railway vehicle; and once the railway vehicle has a tendency to roll to the outer side of the curve, the adjustable torsion bar system provides the unidirectional anti-rolling torque to prevent the railway vehicle from rolling to the outer side of the curve.

2. The method for improving the curvilinear running speed of the railway vehicle according to claim 1, wherein the tilting is realized by using a unilateral ascending tilting method or a one-ascending and one-descending tilting method.

3. The method for improving the curvilinear running speed of the railway vehicle according to claim 2, wherein in the unilateral ascending tilting method, an air spring on the outer side of the curve is inflated using an existing air spring system of the railway vehicle to make a vehicle body of the railway vehicle raised near the outer side of the curve, so that the railway vehicle has tilting to the inner side of the curve.

4. The method for improving the curvilinear running speed of the railway vehicle according to claim 2, wherein in the one-ascending and one-descending tilting method, an air spring on the outer side of the curve is inflated using an existing air spring system of the railway vehicle to make a vehicle body of the railway vehicle raised near the outer side of the curve; and meanwhile, an air spring on the inner side of the curve is deflated to make the vehicle body of the railway vehicle descended near the inner side of the curve, so that the railway vehicle has tilting to the inner side of the curve.

5. The method for improving the curvilinear running speed of the railway vehicle according to claim 1, wherein each of the two hydraulic connecting rods comprises: a rod body, a piston and a control component; the piston is movably arranged in the rod body; the rod body is divided into a liquid cavity I and a liquid cavity II; the liquid cavity I and the liquid cavity II are filled with liquid media; the liquid cavity I is connected with the liquid cavity II through a flow channel I and a flow channel II; a straight-through valve I and a check valve I are arranged on the flow channel I; the liquid media in the liquid cavity I can only flow to the liquid cavity II through the check valve I and the straight-through valve I; a straight-through valve II and a check valve II are arranged on the flow channel II; and the liquid media in the liquid cavity II can only flow to the liquid cavity I through the check valve II and the straight-through valve II.

6. The method for improving the curvilinear running speed of the railway vehicle according to claim 5, wherein when the straight-through valve I is connected and the straight-through valve II is disconnected, the liquid media in the liquid cavity I can only flow to the liquid cavity II through the flow channel I, and the length of the two hydraulic connecting rods is freely elongated under an action of tension; and when the tension is converted into pressure, the liquid media in the liquid cavity II cannot flow to the liquid cavity I, the length of the two hydraulic connecting rods remains unchanged, and the two hydraulic connecting rods are in the unidirectional follow-up elongation state, when the straight-through valve I is disconnected and the straight-through valve II is connected, the liquid media in the liquid cavity II can only flow to the liquid cavity I through the flow channel II, and the length of the two hydraulic connecting rods is freely shortened under an action of pressure; and when the pressure is converted into tension, the liquid media in the liquid cavity I cannot flow to the liquid cavity II, the length of the two hydraulic connecting rods remains unchanged, and the two hydraulic connecting rods are in the unidirectional follow-up shortening state.

* * * * *